US011105028B2

(12) United States Patent
Myers et al.

(10) Patent No.: US 11,105,028 B2
(45) **Date of Patent: *Aug. 31, 2021**

(54) APPARATUS FOR REPLACING ROLLS FOR INTRODUCTION INTO A QUILTER

(71) Applicant: L&P Property Management Company, South Gate, CA (US)

(72) Inventors: Terrance L. Myers, Joplin, MO (US); Matthew C. Smallwood, Webb City, MO (US); Robert D. Eagle, Girard, KS (US)

(73) Assignee: L&P Property Management Company, South Gate, CA (US)

( * ) Notice: Subject to any disclaimer, the term of this patent is extended or adjusted under 35 U.S.C. 154(b) by 180 days.

This patent is subject to a terminal disclaimer.

(21) Appl. No.: 16/536,977

(22) Filed: Aug. 9, 2019

(65) Prior Publication Data

US 2020/0370219 A1 Nov. 26, 2020

Related U.S. Application Data

(63) Continuation of application No. 16/416,912, filed on May 20, 2019.

(51) Int. Cl.

| | |
|---|---|
| ***B65H 19/12*** | (2006.01) |
| ***D05B 33/00*** | (2006.01) |
| ***D05B 11/00*** | (2006.01) |
| ***B65H 16/06*** | (2006.01) |

(52) U.S. Cl.

CPC ..... *D05B 33/00* (2013.01); *B65H 16/06* (2013.01); *B65H 19/126* (2013.01); *D05B 11/00* (2013.01); *B65H 2301/41342* (2013.01); *B65H 2701/177* (2013.01)

(58) Field of Classification Search

CPC ..... B65H 19/126; B65H 16/06; D05B 33/00

See application file for complete search history.

(56) References Cited

U.S. PATENT DOCUMENTS

| | | | |
|---|---|---|---|
| 5,154,130 | A | 10/1992 | Gribetz et al. |
| 5,544,599 | A | 8/1996 | Frazer et al. |
| 5,603,270 | A | 2/1997 | White et al. |
| 6,105,520 | A | 8/2000 | Frazer et al. |
| 6,170,414 | B1 | 1/2001 | Kaetterhenry et al. |
| 6,786,164 | B2 | 9/2004 | Myers et al. |
| 7,735,439 | B1 | 6/2010 | Price et al. |
| 8,794,168 | B2 | 8/2014 | Grob et al. |
| 2003/0136319 | A1 | 7/2003 | Myers et al. |
| 2009/0183662 | A1 | 7/2009 | DeFranks et al. |
| 2011/0030599 | A1 | 2/2011 | Gross et al. |

OTHER PUBLICATIONS

U.S. Patent and Trademark Office; Search Report and Written Opinion in related International Patent Application No. PCT/US2020/033393 dated Aug. 4, 2020; 11 pages.

*Primary Examiner* — William E Dondero

(74) *Attorney, Agent, or Firm* — Wood Herron & Evans LLP

(57) ABSTRACT

An apparatus for replacing a roll of material with a replacement roll of material comprises a loading station and multiple feed stations downstream of the loading station. Each station comprises two legs and a motorized drive assembly extending between the legs. The drive assembly rotates two sprockets and an endless chain surrounding the sprockets inside each of the legs at a station to raise or lower carriages. A roll support extends between the carriages at each station.

19 Claims, 30 Drawing Sheets

APPARATUS FOR REPLACING ROLLS FOR INTRODUCTION INTO A QUILTER

CROSS REFERENCE TO RELATED APPLICATION

The present application is a continuation of U.S. patent application Ser. No. 16/416,912 filed May 20, 2019, which is fully incorporated by reference herein.

FIELD OF THE INVENTION

The present invention relates to quilting machines, and more particularly to an apparatus for replacing rolls of feed material for introduction into a quilting machine.

BACKGROUND OF THE INVENTION

Quilting machines are well known in the art and used to make a variety of quilted products, such as furniture coverings, mattress panels and other quilted covers. One such quilting machine is described in the commonly assigned U.S. Pat. No. 5,154,130, which is fully incorporated by reference herein. Flow of material through the quilting machine may be governed by the apparatus and method disclosed in commonly assigned U.S. Pat. Nos. 5,544,599 and 6,105,520, each one of which is fully incorporated by reference herein. These quilting machines are used to sew together one or more layers of fill material between a fabric covering and a backing material, whereby various stitch lines are created to form functional and decorative patterns in the finished product. Due to market demands for quilted products in a variety of colors and patterns, as well as in a range of quality and price, a single quilting machine is generally used to produce a wide variety of different quilted products. Accordingly, manufacturers must frequently change the cover and fill materials supplied to the quilting machine during production, as much as several times a day.

The materials used in quilting machines fall into two general categories: cover materials and fill materials. Cover materials include the top layer fabric and the bottom layer or backing. The fabric material may be provided in any of a variety of fabric textures, knits, colors, patterns, weights and weaves. Conventional quilting machines are supplied with fabric and backing materials on rolls mounted to the quilting machine. Fill materials, such as foam materials and/or fiber materials, are also provided on rolls and are supplied at specific precut thicknesses for producing the range of quilted products. Rolls of fill material are generally placed on racks in front of the quilting machine and are fed into the quilting machine, along with the cover and backing materials, by feed rollers which pull the materials from the rolls. Multiple filler rolls, with various properties and thicknesses, may be combined to for a multi-layer "sandwich" of filler material between the cover materials.

To accommodate different products, a wide range of cover and fill materials must be stocked and available for use whenever a different final quilted product is desired. For example, one product run might require a sandwich of a two-inch layer of foam material and a one-inch layer of fiber material between a blue cover material and white backing material. The next production run might require the foam material to be one inch thick and the fiber material to be two inches thick. The next production run might require the blue cover material to be purple cover material with a different pattern.

When changeover to produce a different quilted product is necessary during operation, a machine operator must stop the quilting machine, cut the current fabric and/or fill material rolls, remove the current roll or rolls, replace the roll or rolls with the new desired fabric or fill rolls, and attach the new materials to the previous materials being fed into the quilting machine. These operations are highly labor intensive, requiring a significant amount of machine down time and physical exertion by at least one operator.

Mattress manufacturers produce products that cover wide ranges of price and quality. The price and quality of mattresses are affected, in part, by the quality of a quilted cover. The quality of the quilted cover is determined, in part, by the quality and thickness of the material layers, as well as the nature of the quilting process employed. Marketing methods, as well as the demands of the mattress market, have resulted in a trend toward increased variety in mattress covers available to retailers and consumers. Such variety is provided by the production of mattress covers utilizing stitched patterns of a wide variety, as well as employing a wide variety in the layers of fill material used. This trend, coupled with a general trend in merchandizing toward building products to individual retailer orders rather than to the stocking of inventories, has caused mattress manufactures to produce products on a small order basis, sometimes changing the designs of products, including pattern design and ticking material, after the production of a small number of products.

The frequent changing of quilting patterns has been provided by quilting machines, such as that of U.S. Pat. No. 5,154,130, by stitching the patterns under the control of a programmed controller, which has the capability of automatically changing patterns from one quilted item to the next, with or without the manual changing of the arrangements of needles in a needle array. For frequent changes in material the cutting of the material between a supply roll and the quilter is required. The replacement of a supply roll with a new roll and the splicing of the material from the new roll to the trailing edge of the cut-off material is further required. A typical mattress manufacturer will interchange several rolls of material of differing types daily. Such rolls may contain webs that are over ninety inches wide and may be a hundred yards long or longer. Such rolls are heavy and difficult to handle. The roll changing results in substantial manual set-up time, which contributes considerably to quilting machine down time.

Thus, there is a need for an apparatus which reduces the time consuming and labor-intensive process of changing fill and cover material rolls to produce different quilted products during operation.

There is further a need for improvement in the making of material changes in web quilting processes, particularly to increase the speed with which changes can be implemented in mattress cover quilting manufacture.

SUMMARY OF THE INVENTION

One aspect of the present invention is a method of replacing a roll of soft goods on an apparatus upstream of a quilting machine. The method comprises providing an apparatus comprising a base and a rail system spaced above the base with legs, the legs extending between the base and rail system. The apparatus further comprises a trolley movable along the rail system, the trolley having front support holders and rear support holders. The apparatus further comprises a loading station and a plurality of feed stations downstream of the loading station including a first feed station. Each of the stations comprises a pair of legs and a drive assembly extending between the legs. The drive assembly further comprises two sprockets, one of the sprockets being in each leg of the pair of legs. The sprockets within each leg rotate an endless chain inside the leg. A carriage is secured to each of the chains.

The method further comprises providing a replacement roll of material wrapped around a replacement support at the loading station. The replacement support of the replacement roll of material resides in carriages secured to the endless chains at the loading station. The method further comprises providing a used roll of first material wrapped around a first support at the first feed station, the first support residing in carriages secured to the endless chains at the first feed station.

From its upstream home position, a trolley motor moves the trolley downstream enabling the replacement roll of material at the loading station to be lifted by a lifting assembly at the loading station to a raised position above the rail system and above the front support holders of the trolley. Lifting the replacement roll of material at the loading station comprises activating a lifting assembly at the loading station to rotate the endless chains and raise the carriages at the loading station. The method further comprises further moving the trolley downstream to a first loading position in which the front support holders of the trolley are below the replacement support of the replacement roll. By lowering the carriages at the loading station, ends of the replacement support (around which is wound the replacement material to create the replacement roll) are inserted inside the front support holders of the trolley to create a half-full trolley.

The method further comprises lifting the second support (around which is wound the first material to create the used roll) at the first feed station before inserting the second support inside the rear support holders of the trolley. The method further comprises moving the trolley downstream to a position in which the carriages at the first feed station lift the replacement support of the replacement roll of material out of the front support holders of the trolley. The next step comprises further moving the trolley downstream to a position in which the full trolley does not interfere with the next step of lowering the support of the replacement roll of material using two carriages at the first feed station to an operating or lowered position. The next steps comprise moving the trolley upstream before lowering the second support using two carriages at the loading station to a lowered position in which operators may manually remove the second support and remaining material wrapped around the second support.

Worded another way, the method of replacing a roll of soft goods comprises providing an apparatus comprising a base and a rail system spaced above the base with legs. The apparatus further comprises a trolley movable along the rail system. The trolley has a first set of support holders and a second set of support holders. A replacement roll of material wrapped around a replacement support resides in carriages at a loading station. A first support at a feed station downstream of the loading station resides in carriages at the feed station.

The method comprises moving the trolley downstream from a home position so that the trolley does not interfere with the next step of lifting the replacement roll of material at the loading station by raising the replacement support using the carriages at the loading station. The next step comprises inserting the replacement support inside the first set of support holders of the trolley. Another step comprises lifting the first support at the feed station. The next step comprises lowering the first support into the second set of support holders of the trolley to create a fully loaded trolley. The next step comprises moving the fully loaded trolley downstream to a position such that the carriages at the feed station lift the replacement support out of the first set of support holders of the trolley. The next step comprises further moving the trolley downstream to a non-interfering position. The next step comprises lowering the replacement support using the carriages at the feed station to an operating or lowered position. The trolley is then moved upstream. The next step comprises lowering the first support using two carriages at the loading station to a lowered position in which the first support may be manually removed from the carriages at the loading station to be replaced.

Worded another way, the method of replacing a roll of soft goods comprises inserting a replacement support supporting a replacement roll of material into carriages at a loading station at an upstream end of an apparatus. The apparatus comprises a base, a rail system spaced above the base with legs and a trolley movable along the rail system. The trolley has front and rear support holders. The first step comprises moving the trolley downstream from its home position. The next step comprises activating a motor at the loading station to raise the carriages at the loading station to lift the replacement support into a raised position above the rail system. The next step comprises moving the trolley such that the front support holders of the trolley are below the replacement support. The replacement support is then lowered into the front support holders of the trolley by lowering the carriages at the loading station to create a half-full trolley. The half-full trolley is then further moved. The next step comprises activating a motor at a feed station downstream of the loading station to raise carriages at the feed station to lift a first support into a raised position above the rail system. The first support is then lowered into the rear support holders of the trolley by lowering the carriages at the feed station to create a fully loaded trolley. The fully loaded trolley is then moved downstream to a first unloading position. The next step comprises activating the motor at the feed station to raise the carriages at the feed station to lift the replacement support out of the front support holders of the trolley with the trolley in its first unloading position. The next step comprises further moving the trolley before lowering the replacement support using the carriages at the feed station. The next step comprises moving the trolley upstream to a second unloading position. The next step comprises activating the motor at the loading station to raise the carriages at the loading station to lift the first support out of the rear support holders of the trolley with the trolley in its second unloading position. The next step comprises further moving the trolley back to its home position and lowering the first support using the carriages at the loading station.

By virtue of the foregoing, the apparatus provides a way to replace a fully used, partially used or even unused roll of soft goods with another full roll of a soft good at any one of multiple feed stations upstream of a quilter. Using the apparatus of the present invention, operators need not manually lift and remove heavy rolls of material to the extent required currently. The automatic handling of rolls of soft goods provides an ergonomic benefit and reduces downtime when the quilter is not operating. The apparatus improves the efficiency of the quilting process. An additional advantage is that consistent material splice points are achieved.

These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, explain the principles of the present invention.

DETAILED DESCRIPTION OF THE DRAWINGS

Figure 1:
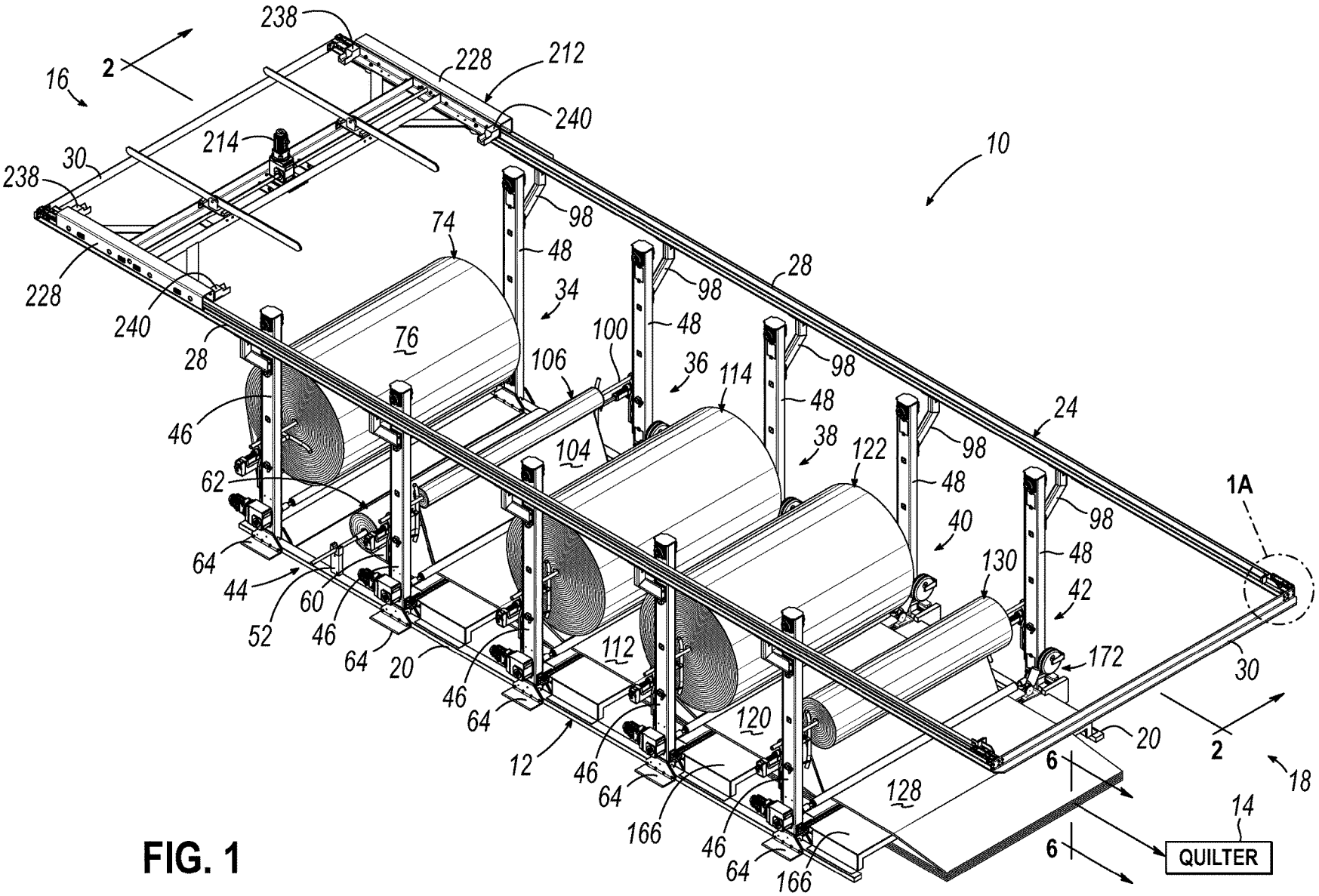
FIG. 1 is a front perspective view of an apparatus for performing the method of replacing a roll of soft goods in accordance with the principles of the present invention.

With reference to FIG. 1, there is shown an apparatus 10 for changing covering material, fill materials and ticking material or any combination thereof to create a stack 25 of soft goods (shown in detail in FIG. 6) for introduction into a quilter 14. For purposes of this document, the apparatus 10 has a front or upstream end 16 and a rear or downstream end 18. The terms upstream and downstream refer to the flow of materials as they pass through the apparatus 10 into the quilter 14. The stack 25 of soft goods is located at the downstream end of the apparatus 10 prior to entering the quilter 14.

The apparatus 10 comprises a base 12 adapted to rest on the floor of a building (not shown). The base 12 comprises two parallel sides 20 and a plurality of braces 22 extending between the sides 20 of the base 12. Although the drawings show one brace 22 at each station, any number of braces may be used at each station. Any number of braces of any desired configuration may be used in the base. Although the drawings show one type of base, any other type of base may be used in accordance with the present invention.

Figure 1A:
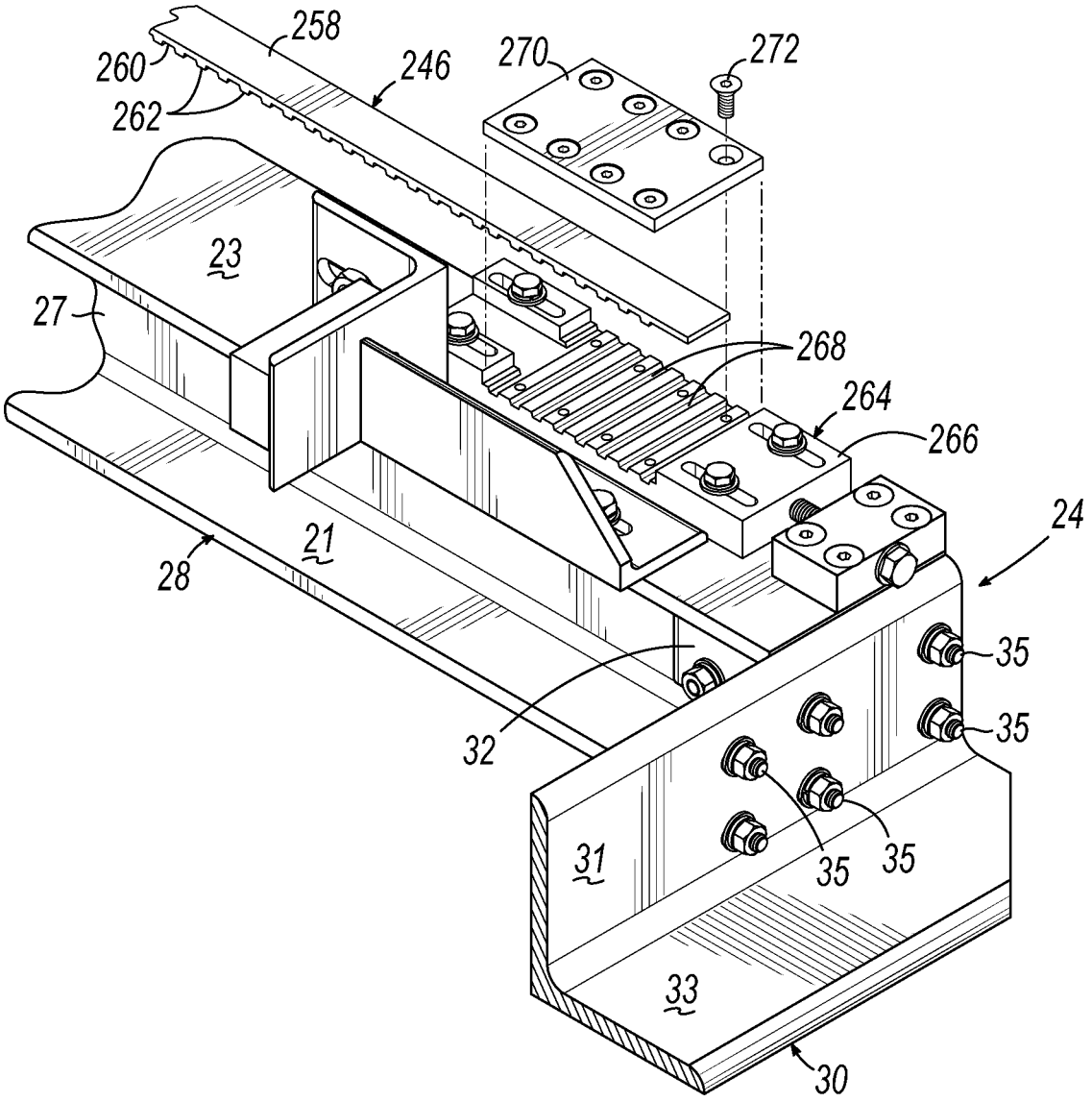
FIG. 1A is an enlarged view of the encircled area 1A of FIG. 1.
Figure 3:
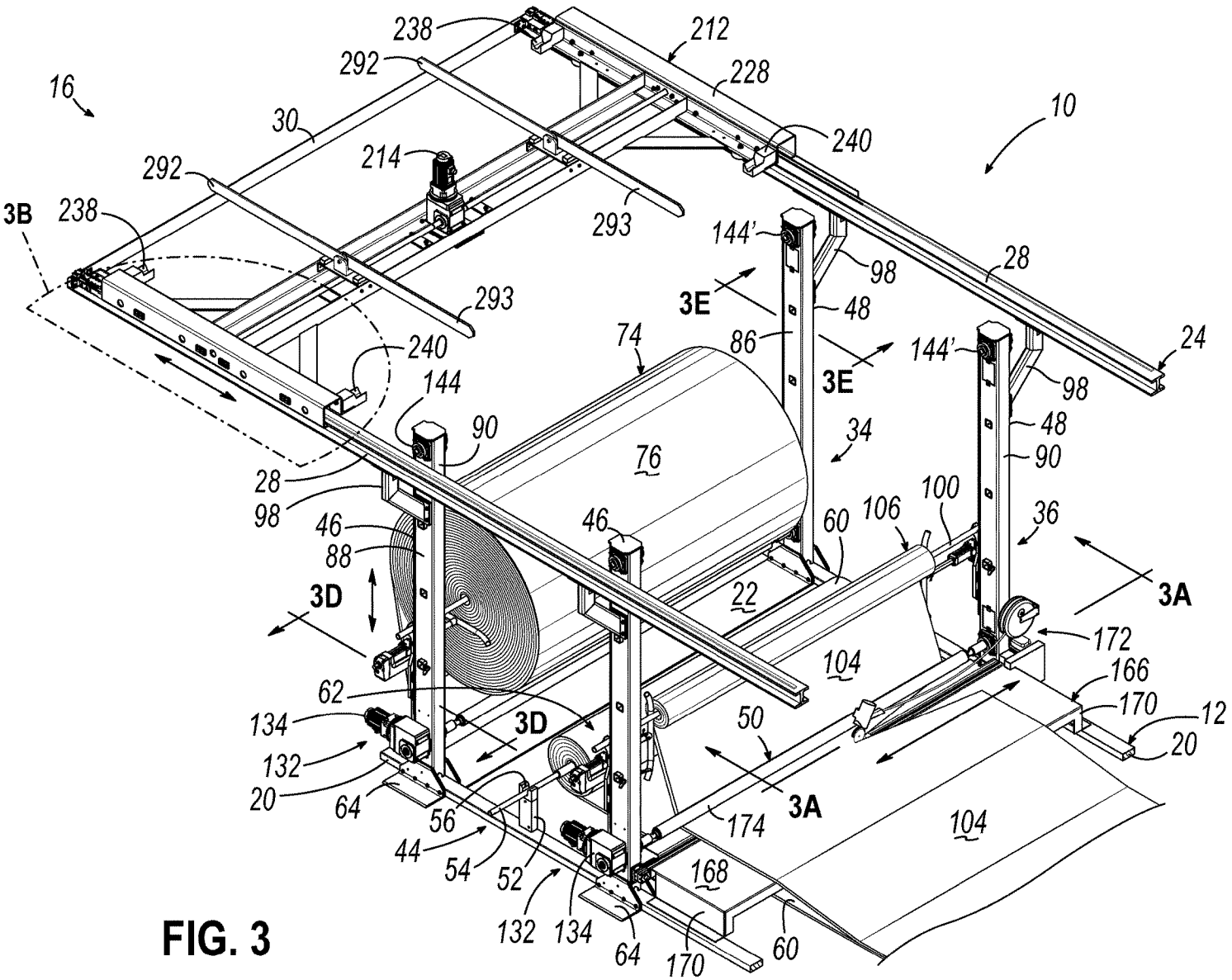
FIG. 3 is a perspective view of a portion of the apparatus of FIG. 1.

The apparatus 10 further comprises a rail system 24 spaced above the base 12 with drive legs 46 and driven legs 48. As shown in FIG. 1, the drive legs 46 are secured to one side 20 of the base 12 and the driven legs 48 are secured to the other side 20 of the base 12. The rail system 24 is generally rectangular, having two side rails 28 and two end rails 30 joined together with corner brackets 32 (only one being shown in FIG. 1A). In the illustrated embodiment, as best shown in FIG. 3B, each of the side rails 28 has an "I" shaped cross-section comprising a vertically oriented center portion 27, a horizontally oriented upper flange 23 and a horizontally oriented lower flange 21. In the illustrated embodiment, as best illustrated in FIG. 1A, each of the end rails 30 has an "L" shaped cross-section comprising a vertically oriented portion 31 and a horizontally oriented portion 33 extending outwardly from the bottom of the vertically oriented portion 31. As best shown in FIG. 1A, one of the corner brackets 32 secures the center portion 27 of one end of each side rail 28 to the vertically oriented portion 31 of an end rail 30 with fasteners 35, shown as nuts and bolts. Although the rail system 24 is illustrated being generally rectangular, it may any desired shape.

Figure 2:
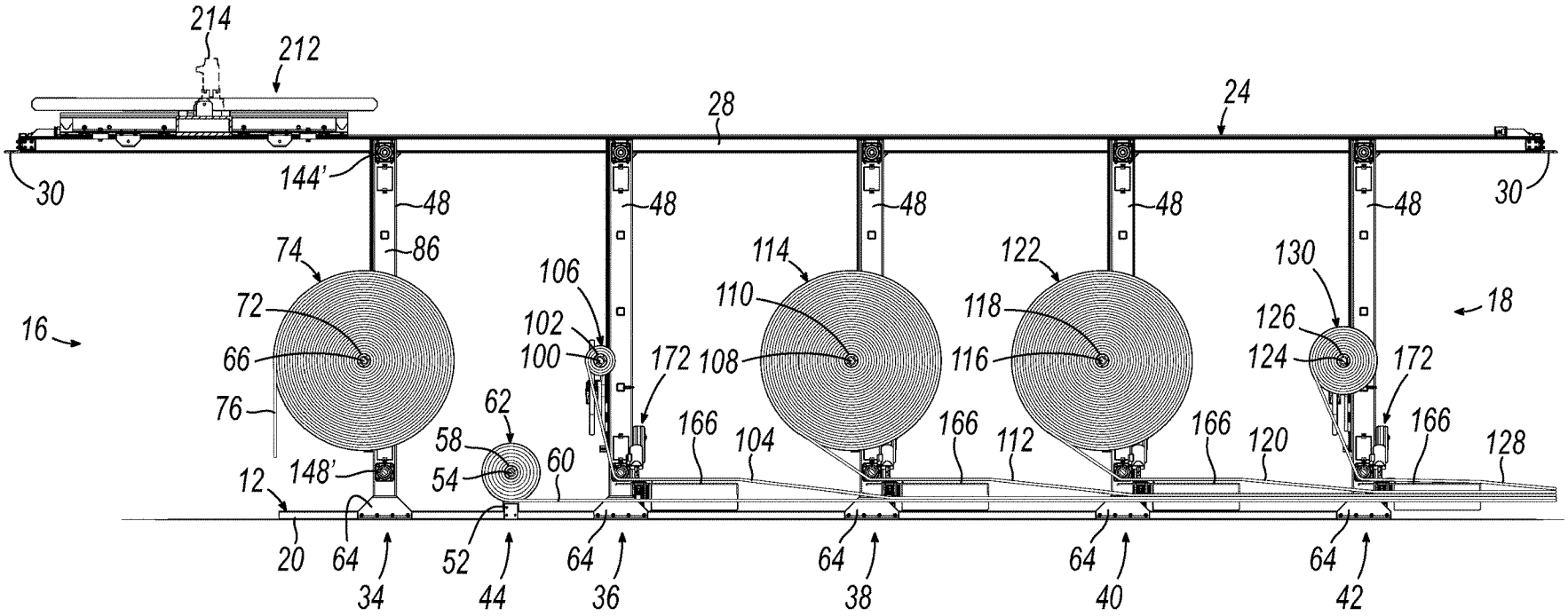
FIG. 2 is a cross-sectional view taken along the line 2-2 of FIG. 1.

As best shown in FIGS. 1-2, the apparatus 10 further comprises a loading station 34 at the upstream end 16 of the apparatus 10, a first feed station 36 downstream of the loading station 34, a second feed station 38 downstream of the first feed station 36, a third feed station 40 downstream of the second feed station 38 and a fourth feed station 42 downstream of the third feed station 40.

A non-motorized backing station 44 is located between the loading station 34 and first feed station 36. The non-motorized backing station 44 comprises two risers 52 (only one being shown), each riser 52 being secured to one of the sides 20 of base 12 in any conventional manner. As best shown in FIGS. 2 and 3, a backing support 54 extends transversely or from side-to-side and is removably supported by the risers 52. More particularly, the backing support 54 sits inside a downwardly extending notch 56 in each of the risers 52. As best shown in FIG. 2, the backing support 54 passes through a cardboard tube 58 around which a web of backing material 60 is rolled to create a roll of backing 62. The backing support 54 is commonly a metal tube but may be a solid member. When the roll of backing 62 runs out, the backing support 54 may be lifted away from the risers 52 quickly and easily before being separated from the empty cardboard tube 58. The backing support 54 may then be passed through a cardboard tube of a full roll of backing 62 and manually lifted back into the notches 56 of the risers 52. Any form of known riser may be used; the drawings are not intended to be limiting.

Although the illustrated apparatus 10 includes four feed stations 36, 38, 40 and 42 downstream of backing station 44, any number of feed stations may be incorporated into an apparatus in accordance with the present invention. If desired, the roll of backing material may be used at any feed station too.

In the illustrated embodiment, each of the feed stations 36, 38, 40 and 42 and the loading station 34 comprises a drive leg 46, a driven leg 48 and a drive assembly 50 extending between the drive leg 46 and the driven leg 48. As best shown in FIG. 3, each of the drive/driven legs 46, 48 has an inner wall 86, an outer wall 88 and two side walls 90 defining a hollow interior 92.

Figure 3A:
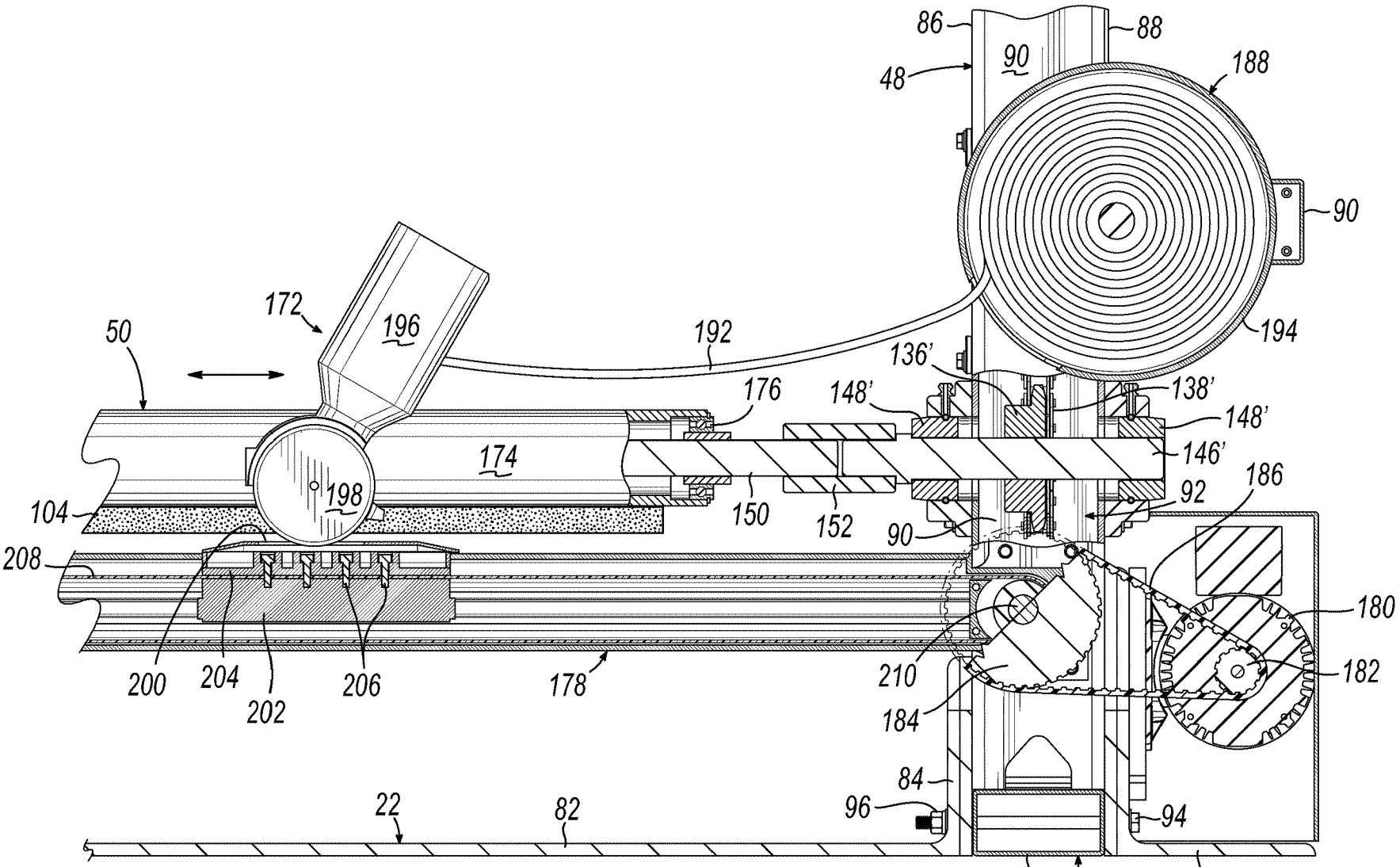
FIG. 3A is a cross-sectional view taken along the line 3A-3A of FIG. 3.
Figure 3B:
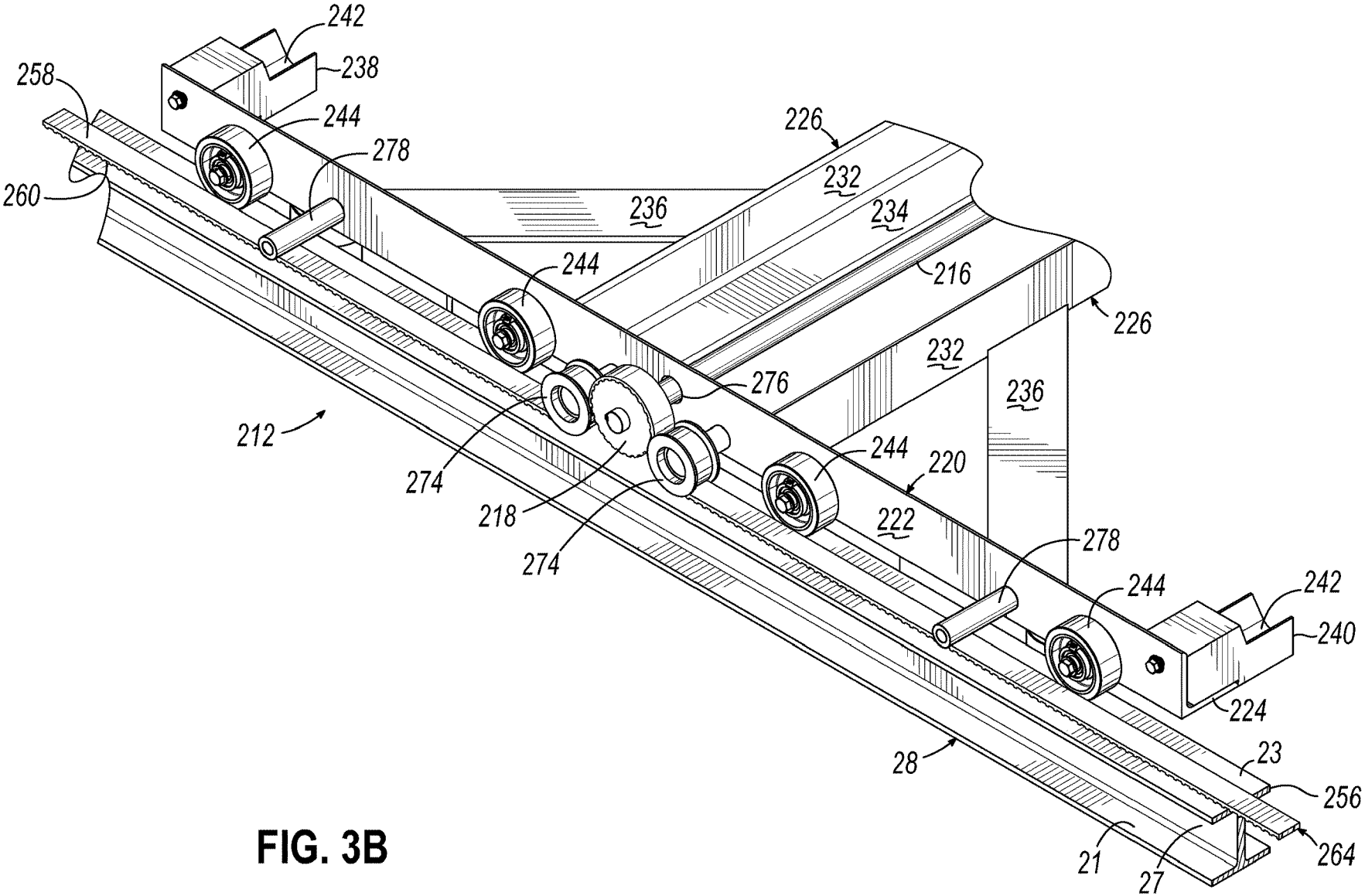
FIG. 3B is an enlarged perspective view of the semi-circular area 3B of FIG. 3.

Each drive leg 46 and corresponding driven leg 48 at each of the feed stations 36, 38, 40 and 42 and the loading station 34 is secured to one of the sides 20 of the base 12 with an L-shaped mounting bracket 64 on the outside of the leg, as shown in FIG. 3A. As best shown in FIG. 3A, a generally U-shaped brace 22 is secured to an inside wall 86 of one of the drive legs 46 and an inside wall 86 of a corresponding driven leg 48 at each of the feed stations 36, 38, 40 and 42 and the loading station 34. As shown in FIG. 3A, the generally U-shaped brace 22 has a bottom 82 which rests on a floor or supporting surface and an upwardly turned leg 84 at each end (only one being shown). As shown in FIG. 3A, one of the upwardly turned legs 84 of the generally U-shaped brace 22 and one of the L-shaped mounting brackets 64 are bolted to one of the legs 46, 48 with bolt 94 and nut 96, the bolt 94 extending through the interior one of the sides 20 of base 12.

The drive leg 46 at each of the feed stations 36, 38, 40 and 42 and the loading station 34 is secured to one of the side rails 28 of the rail system 24 with a brace bracket 98 on the outside of the leg 46, as best shown in FIG. 3. Similarly, each corresponding driven leg 48 is secured to one of the side rails 28 of the rail system 24 with a brace bracket 98 on the outside of the leg 48, as best shown in FIG. 3.

Figure 3C:
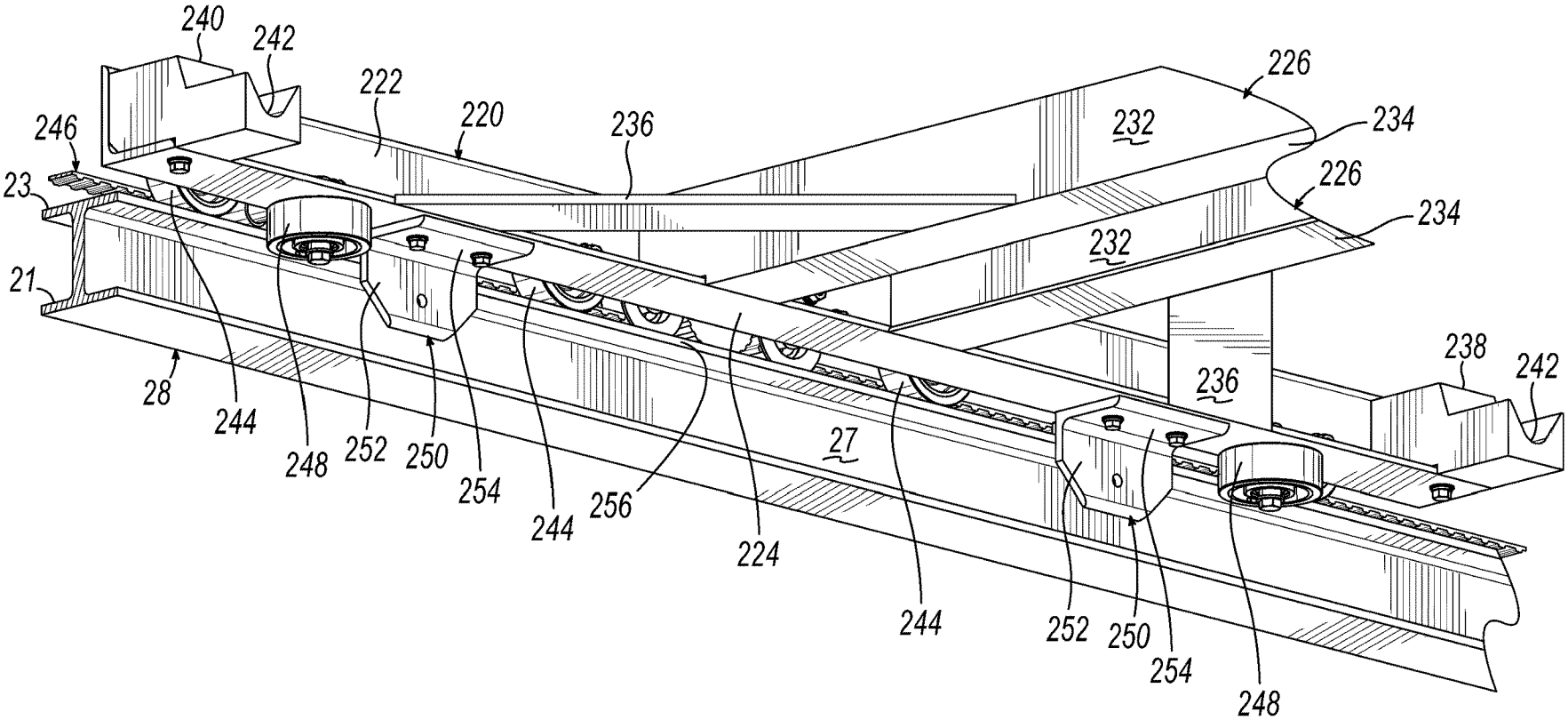
FIG. 3C is a bottom perspective view of a portion of the apparatus of FIG. 3B.
Figure 3D:
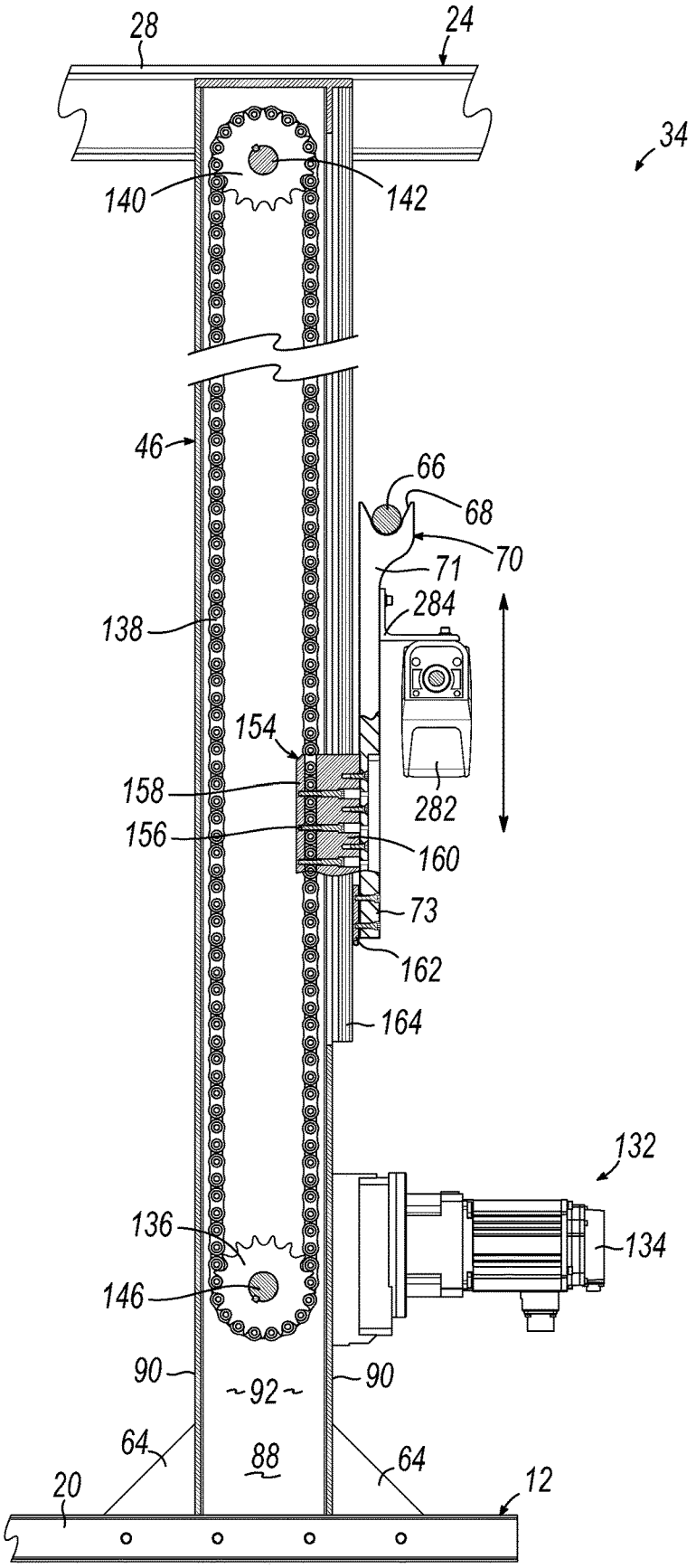
FIG. 3D is a cross-sectional view taken along the line 3D-3D of FIG. 3.
Figure 3E:
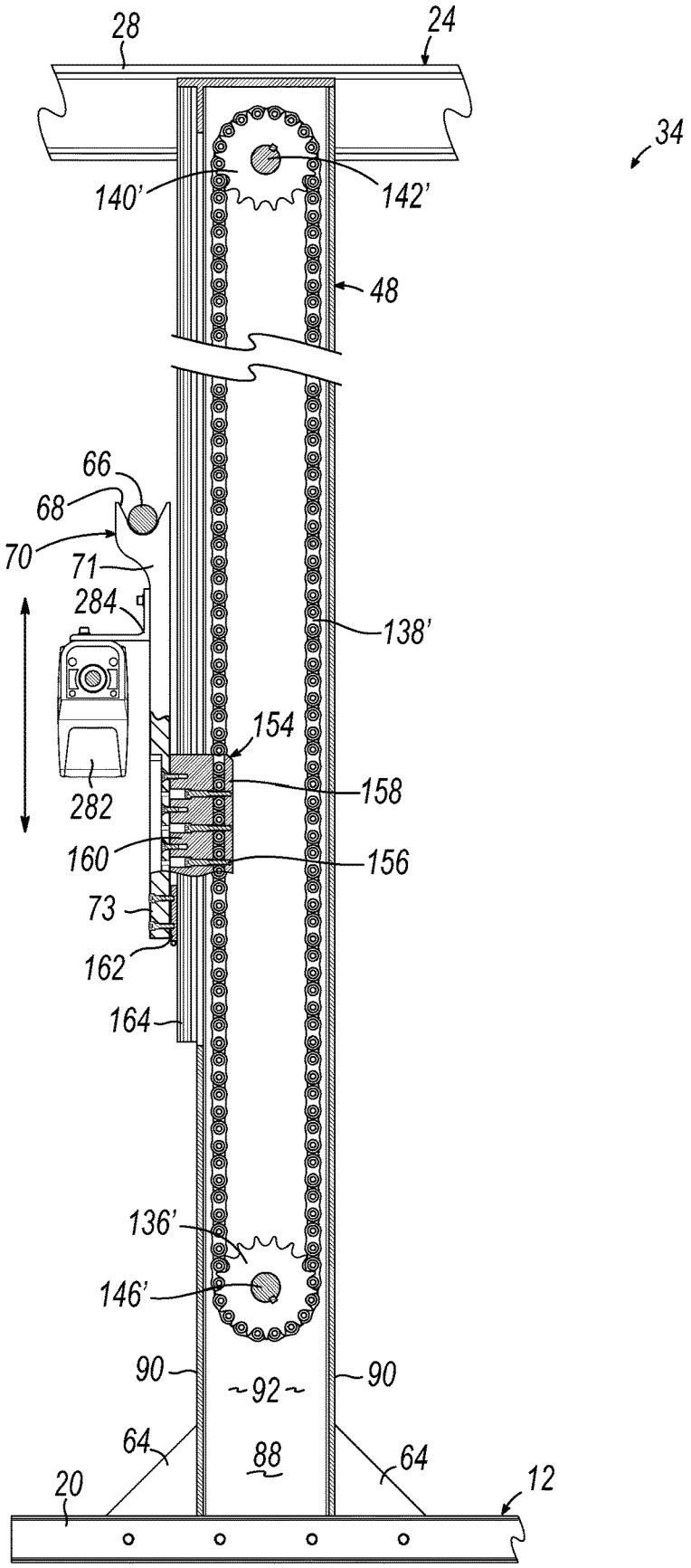
FIG. 3E is a cross-sectional view taken along the line 3E-3E of FIG. 3.
Figure 3F:
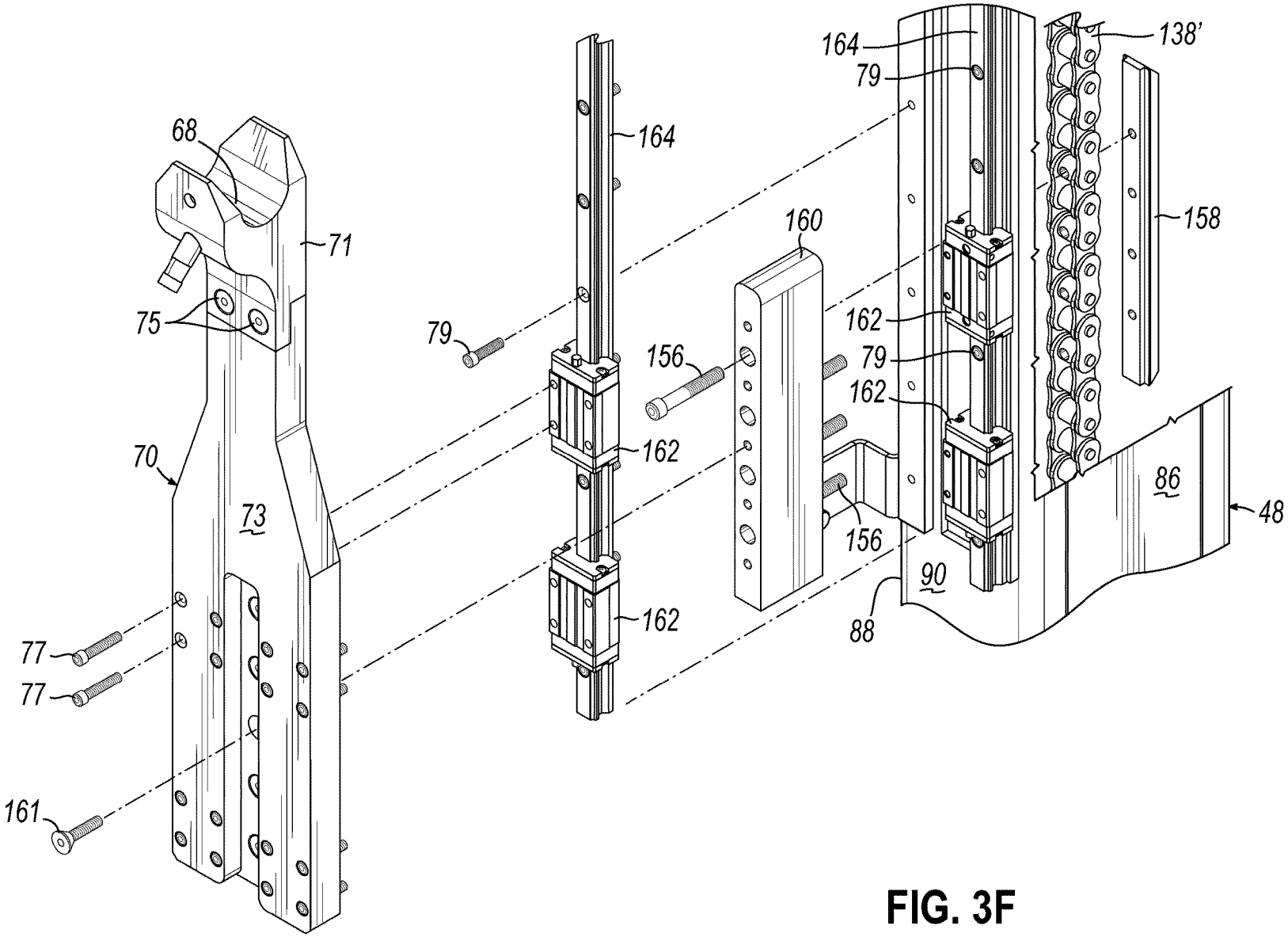
FIG. 3F is a partially disassembled view of a portion of one of the legs of the apparatus.
Figure 4A:
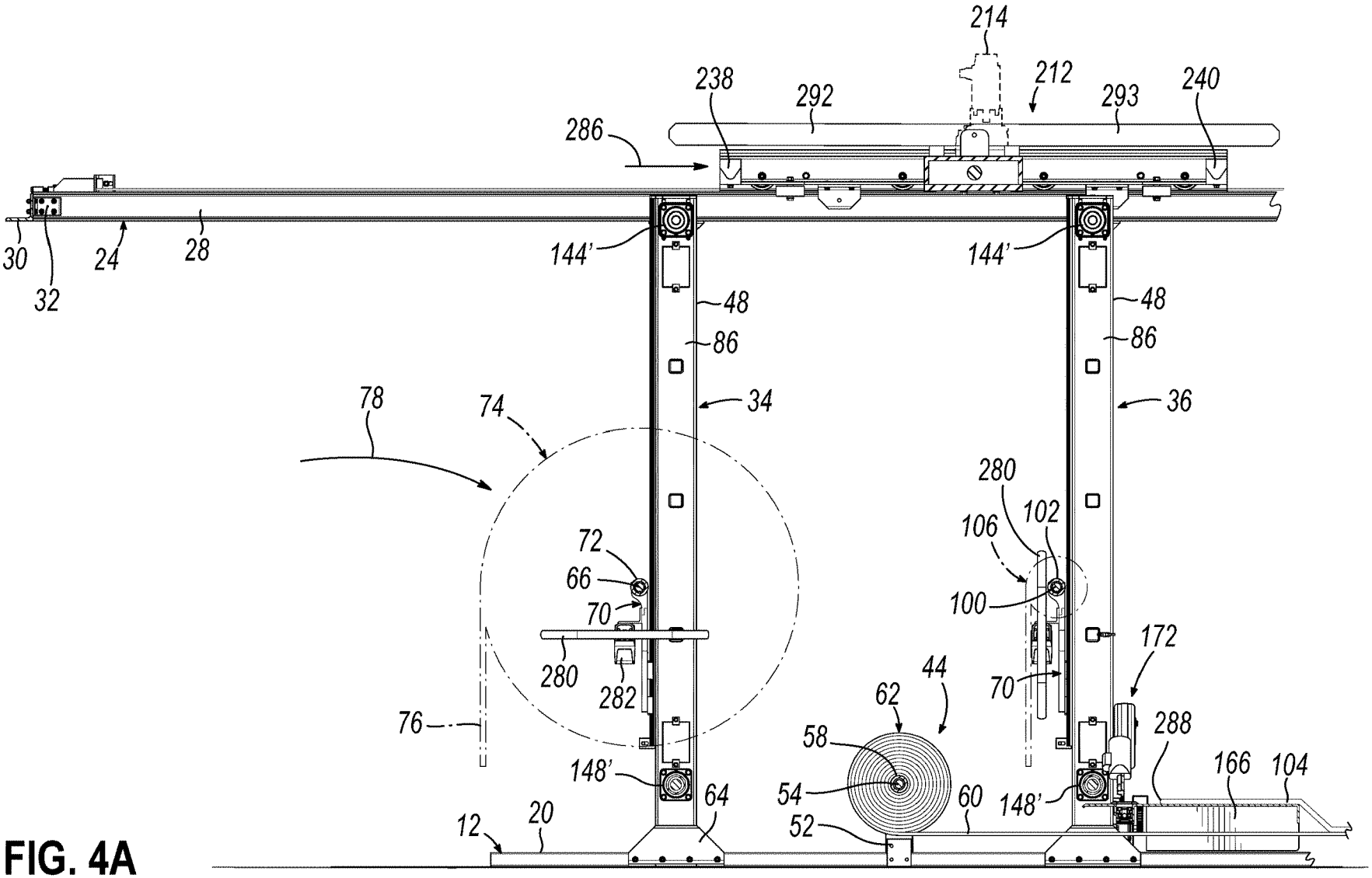
FIG. 4A is a side view of the portion of the apparatus shown in FIG. 3 showing the trolley moving rearwardly at the beginning of a process of replacing a used roll of material.

As best shown in FIGS. 3D and 3E, at the loading station 34 a replacement support 66 sits inside downwardly extending generally U-shaped nests 68 in carriages 70. The replacement support 66 supporting replacement roll 74 move up and down with the carriages 70, as described below. As shown in FIG. 3F, each carriage 70 comprises an upper portion 71 including a generally U-shaped nest 68 and a lower plate 73. The lower plate 73 is secured to the upper portion 71 with fasteners 75. As best shown in FIG. 2, the replacement support 66 passes through a cardboard tube 72 around which a web of replacement material 76 is rolled to create a replacement roll 74. As best shown in FIG. 4A, to insert a replacement support 66 supporting a full replacement roll 74 in the nests 68 in carriages 70, operators must manually place the replacement support 66 into the nests 68 in carriages 70 in the direction of arrow 78. As best shown in FIG. 4Q, to remove a roll of first material 106 from the nests 68 in carriages 70, operators must manually remove the first support 100 from the nests 68 in carriages 70 in the direction of arrow 80.

As best shown in FIGS. 1 and 2, at the first feed station 36 a first support 100 sits inside downwardly extending nests 68 in carriages 70 and moves up and down with the carriages 70, as described below. The first support 100 passes through a cardboard tube 102 around which a web of first material 104 is rolled to create a roll of first material 106. The drawings show the roll of first material 106 being mostly used and ready to be replaced. For purposes of this document, the roll of first material 106 will also be referred to as a used roll.

Figure 6:
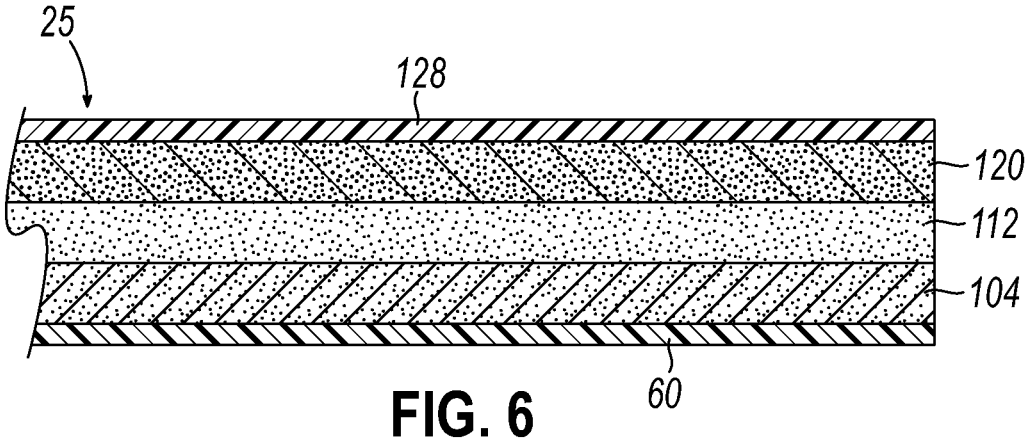
FIG. 6 is a cross-sectional view taken along the line 6-6 of FIG. 1.

FIGS. 4A-4Q illustrate the process of replacing the used roll 106 with a replacement roll 74 to continue the feeding of material to create the stack 25 shown in FIG. 6 for introduction into quilter 14. Although FIGS. 4A-4Q illustrate the process of replacing the used roll 106 with a replacement roll 74 at the first feed station 36, any of the other rolls of material may be replaced with a replacement roll of any desired material at any one of the feed stations in accordance with the principles of the present invention.

As best shown in FIGS. 1 and 2, at the second feed station 38 a second support 108 sits inside downwardly extending nests 68 in carriages 70 and moves up and down with the carriages 70, as described below. The second support 108 passes through a cardboard tube 110 around which a web of second material 112 is rolled to create a roll of second material 114.

As best shown in FIGS. 1 and 2, at the third feed station 40 a third support 116 sits inside downwardly extending nests 68 in carriages 70 and moves up and down with the carriages 70, as described below. The third support 116 passes through a cardboard tube 118 around which a web of third material 120 is rolled to create a roll of third material 122.

As best shown in FIGS. 1 and 2, at the fourth feed station 42 a fourth support 124 sits inside downwardly extending nests 68 in carriages 70 and moves up and down with the carriages 70, as described below. The fourth support 124 passes through a cardboard tube 126 around which a web of ticking material 128 is rolled to create a roll of ticking material 130.

The web of first material 104 may be any known material commonly used in a quilt such as foam or fiber or any combination thereof. The web of second material 112 may be any known material commonly used in a quilt such as foam or fiber or any combination thereof. The web of third material 120 may be any known material commonly used in a quilt such as foam or fiber or any combination thereof. The web of replacement material 76 may be identical to either the web of first material 104, the web of second material 112 or the web of third material 120. The webs of first, second and third materials are the materials used to create the stack 25 shown in FIG. 6.

Similarly, the web of backing material 60 and the web of ticking material 128 may be any known material used as backing in the industry. The present invention is not intended to limit the materials which may be introduced into the quilter 14.

The apparatus 10 further comprising a lifting assembly 132 at the loading station 34 and each of the feed stations 36, 38, 40 and 42. Each lifting assembly 132 comprises one drive leg 46, a driven leg 48 and a drive assembly 50 extending between the legs 46, 48. FIG. 3D illustrates a cross-section of a drive leg 46 and FIG. 3E illustrates a cross-section of a corresponding driven leg 48 on the opposite side of the base 12. Each lifting assembly 132 functions to raise and lower two carriages 70 simultaneously, one per leg 46, 48, between a raised position and a lowered position. Therefore, at each station the two carriages 70, one per leg, are at the same height regardless of their position.

As best shown in FIG. 3D, the lifting assembly 132 is powered by a lift motor 134 which rotates an end shaft 146 which rotates a lower sprocket 136 inside the hollow interior 92 of the drive leg 46. As shown in FIG. 3D, an endless chain 138 is wrapped around an upper sprocket 140 as well as the lower sprocket 136 inside the hollow interior 92 of the drive leg 46. Rotation of the lower sprocket 136 due to operation of the lift motor 134 rotates the endless chain 138 which rotates the upper sprocket 140. The upper sprocket 140 is held in place inside the hollow interior 92 of the drive leg 46 by an upper shaft 142 which extends between two bearing assemblies 144 (only one being shown in FIG. 3) secured to the inner and outer walls 86, 88 of the drive leg 46. As shown in FIG. 3A, rotation of the end shaft 146 by the lift motor 134 rotates the lower sprocket 136 which extends between two bearing assemblies 148 secured to the inner and outer walls 86, 88 of the drive leg 46.

As best shown in FIG. 3A, the drive assembly 50 comprises two end shafts 146, 146' and a middle shaft 150 therebetween. Each end shaft 146, 146' is aligned with the middle shaft 150 and partially surrounded by a collar 152 (only one being shown). FIG. 3A shows the driven end of the drive assembly 50. As shown in FIG. 3A, at the driven end of the drive assembly 50, another end shaft 146' is rotated by rotation of the middle shaft 150. As shown in FIG. 3E, rotation of the end shaft 146' rotates a lower sprocket 136' which rotates an endless chain 138'. The lower sprocket 136' is within the hollow interior of the driven leg 48. The end shaft 146' extends between two bearing assemblies 148' secured to the inner and outer walls 86, 88 of the driven leg 48. Rotation of the endless chain 138' rotates an upper sprocket 140'. The upper sprocket 140' is supported by an upper shaft 142' which extends between two bearing assemblies 144' (only one being shown in FIG. 3) secured to the inner and outer walls 86, 88 of the driven leg 48.

FIG. 3A illustrates an idler roller 174 surrounding the middle shaft 150 of the drive assembly 50. The idler roller 174 rotates freely regardless of whether the middle shaft 150 of the drive assembly 50 is rotating due to bearings 176 surrounding the middle shaft 150 of the drive assembly 50.

FIGS. 3D, 3E and 3F illustrate how each carriage 70 is secured to one of the endless chains: endless chain 138 in the hollow interior 92 of the drive leg 46 or endless chain 138' in the hollow interior 92 of the driven leg 48. As best shown in FIGS. 3D and 3E, a two-piece mount 154 allows one of the carriages 70 to be secured to one of the endless chains 138, 138'. Large fasteners 156 extend through inside and outside pieces 158, 160 of the two-piece mount 154 and through one of the endless chains 138, 138'. As shown in FIG. 3F, the outside piece 160 of the two-piece mount 142 is secured to the lower plate 73 of a carriage 70 with small fasteners 161.

As shown in FIG. 3F, movement of each carriage 70 is guided by two stationary guide rails 164 secured to one of the side walls 90 of one of the legs 46, 48 with fasteners 79. Although FIG. 3F shows a portion of one of the driven legs 48, each of the driven legs 48 has the same structure to guide movement of the carriage 70 moving along the driven leg 48. As shown in FIG. 3F, each of four guides 162 is secured to the lower plate 73 of a carriage 70 with fasteners 77. Two guides 162 are on each side of the endless chain 138'. Two of the guides 162 move along each one of two stationary guide rails 164. See FIG. 3F. The guides 162 move along the stationary guide rails 164 with one of the carriages 70 as the carriages 70 are moved by the endless chains 138, 138'.

As best shown in FIGS. 1 and 2, the apparatus 10 further comprises a catwalk 166 at each of the feed stations 36, 38, 40 and 42 downstream of the legs 46, 48 of each of the feed stations. As best shown in FIG. 3, each catwalk 166 comprises a generally planar catwalk platform 168 supported off the floor by legs 170 secured to the sides 20 of base 12. The catwalk 166 may be used to access portions of the apparatus 10 for repairs or other purposes as well as providing a portion of a cutting assembly 172 shown in detail in FIG. 3A. Each catwalk 166 allows an operator to cut one of the webs of material prior to removing a roll without cutting the other webs of material. As best shown in FIG. 2, only the web of material exiting the roll at an individual feed station passes over the catwalk 166 of the feed station. The other webs of material from the rolls upstream of the individual feed station pass under the catwalk 166 at the individual feed station.

Figure 5:
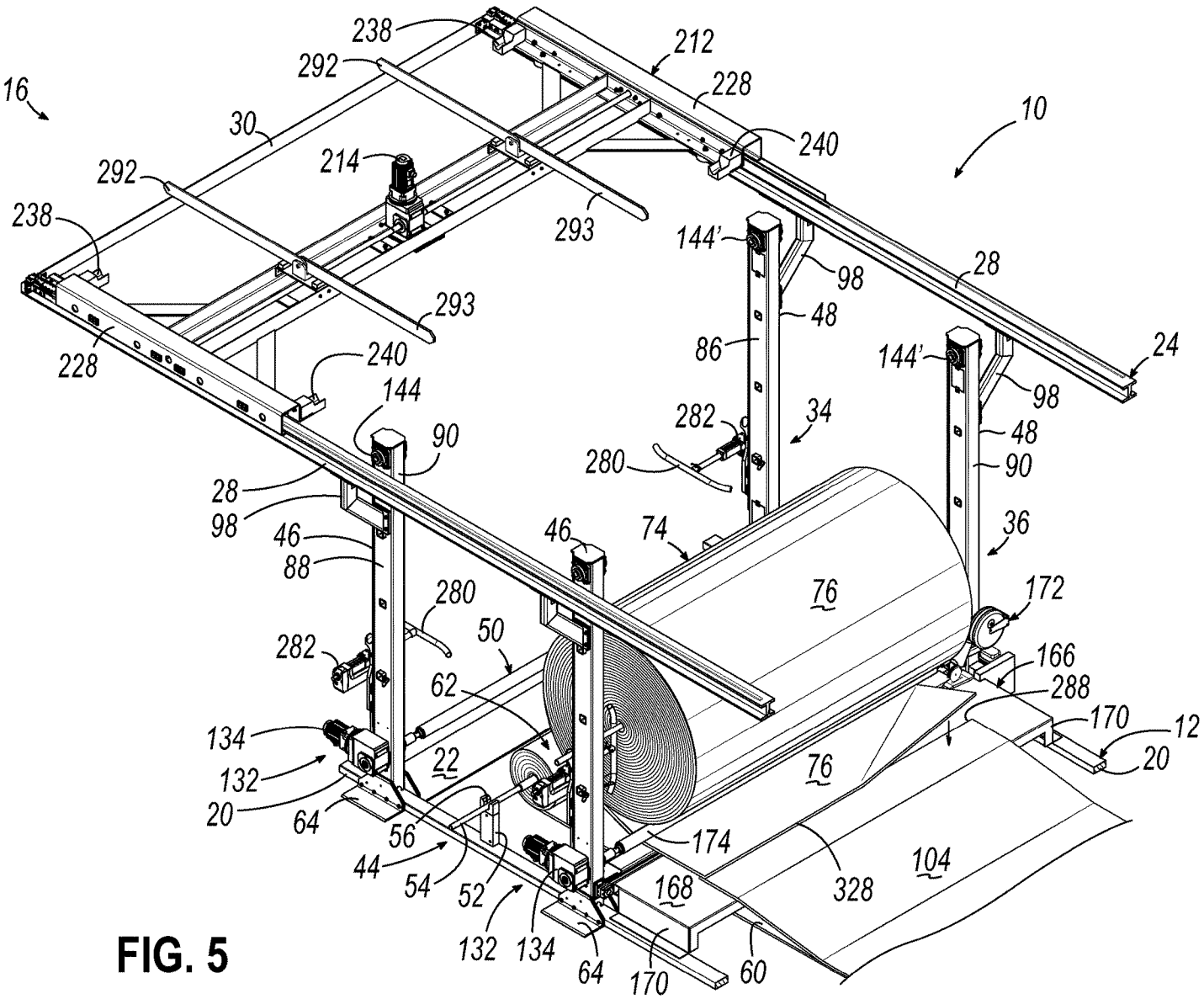
FIG. 5 is a perspective view of the portion of the apparatus shown in FIG. 3 showing the trolley in its home position and the carriages at the loading and first feed stations being in their lowered positions.

As shown in FIG. 5, each cutting assembly 172 allows an operator to cut one of the webs of material prior to removing a roll to create a trailing edge of the web of material and splice such trailing edge to a leading edge of a replacement edge of material. FIG. 5 illustrates splicing a leading edge 328 of the web of replacement material 76 of replacement roll 74 to a trailing edge 288 of the web of first material 104 laying on the catwalk 166 at the first feed station 36. However, this process may occur at any station to replace any of the rolls of material.

As best shown in FIG. 3A, each cutting assembly 172 comprises a linear actuator 178 powered by a cutter motor 180. The cutter motor 180 rotates a motor pulley 182 which rotates an actuator pulley 184 via a timing belt 186 which surrounds the motor pulley 182 and actuator pulley 184. Rotation of the actuator pulley 184 rotates a drive shaft 210 which rotates an endless belt 208 of the linear actuator 178. Any known linear actuator may be used, but one which has proven satisfactory is available at http://us.item24.com.en.

As shown in FIG. 3A, each cutting assembly 172 includes a cord reel 188 which is secured to one of the driven legs 48 with a bracket 190. Each cord reel 188 comprises a cord 192 rolled up inside a housing 194. The power cord 192 travels with a cutter motor 196 which rotates a circular cutting blade 198. The other end of the power cord 192 is connector to a power source which supplies power to the cutter motor 196. The circular cutting blade 198 extends through a slot 200 in an upper shoe 204. The upper shoe 204 is secured to a slide 202 which is moved from side-to-side by the linear actuator 178. The slide 202 is secured to the endless belt 208 with fasteners 206. The endless belt 208 and slide 202 form part of the linear actuator 178.

As best shown in FIGS. 3B and 3C, the apparatus 10 further comprises a trolley 212 which travels along the rail system 24. The trolley 212 is powered by a trolley motor 214 which travels with the trolley 212. The trolley motor 214 rotates two trolley shafts 216. Each trolley shaft 216 extends outwardly from the trolley motor 214, through one of the trolley sides 220 as described below and is connected to a trolley wheel 218 (only one being shown in FIG. 3B).

The trolley 212 comprises two trolley sides 220, each trolley side 220 being an angle iron having a vertical wall 222 and a horizontal wall 224. The trolley 212 further comprises two trolley braces 226 extending between the trolley sides 220. As shown in FIGS. 3B and 3C, each trolley brace 226 is an angle iron having a vertical wall 232 and a horizontal wall 234. As shown in FIGS. 3B and 3C, a stabilizer 236 extends between the horizontal wall 234 of one of the trolley braces 226 and the horizontal wall 224 of one of the trolley sides 220. As shown in FIG. 3B, each of the trolley shafts 216 extends through an opening 274 in one of the vertical walls 222 of one of the trolley sides 220.

As best shown in FIGS. 3B and 3C, the trolley 212 further comprises a pair of front support holders 238 (only one being shown in FIGS. 3B and 3C) and a pair of rear support holders 240 (only one being shown in FIGS. 3B and 3C). Each of the front support holders 238 is secured to one of the trolley sides 220. Each of the rear support holders 140 is secured to one of the trolley sides 220. As best shown in FIGS. 3B and 3C, each of the front and rear support holders 238, 240 has a dip 242 sized to receive and retain one end of one of the supports passing through one of the rolls, regardless of whether the support is a tube or a bar or some other known shape.

As best shown in FIGS. 3B and 3C, the trolley 212 further comprises outside rollers 244 secured to each trolley side 220 and more particularly secured to the vertical wall 222 of each trolley side 220. They rotate as the trolley 212 moves and contacts the upper flange 23 of the side rail 28 of the rail system 24. They are not powered. They raise the trolley 212 above the upper flange 23 of the side rail 28 of the rail system 24 so the trolley 212 may travel freely. Although FIG. 3B shows four outside rollers 244 secured to each side 220 of trolley 212, any number of outside rollers may be secured to each side of the trolley. The outside rollers 244 secured to each side 220 of trolley 212 do not interfere with the movement of the ribbed strap 246 described below.

As best shown in FIGS. 3B and 3C, the trolley 212 further comprises inside rollers 248 secured to each trolley side 220 and more particularly secured to the horizontal wall 224 of each trolley side 220. They rotate as the trolley 212 moves and contact an inner edge 256 of the upper flange 23 of the side rail 28 of the rail system 24. They are not powered. They maintain the trolley 212 aligned properly relative to the upper flange 23 of the side rail 28 of the rail system 24 so the trolley 212 may travel freely. Although FIG. 3C shows two inside rollers 248 secured to each side 220 of trolley 212, any number of inside rollers may be secured to each side of the trolley. The inside rollers 248 secured to each side 220 of trolley 212 do not interfere with the movement of the ribbed strap 246 described below.

As best shown in FIG. 3C, the trolley 212 further comprises four lower brackets 250, two being secured to each trolley side 220. Each lower bracket 250 is generally L-shaped having a vertical leg 252 and a horizontal leg 254. As shown in FIG. 3C, the horizontal leg 254 of each of the spaced lower brackets 250 is secured to the horizontal wall 224 of each trolley side 220. As the trolley 212 moves, the lower brackets 250 may contact the inner edge 256 upper flange 23 of the side rail 28 of the rail system 24 to ensure the trolley 212 moves as desired without undesirable lateral movement. They maintain the trolley 212 aligned properly relative to the upper flange 23 of the side rail 28 of the rail system 24 so the trolley 212 may travel freely. Although FIG. 3C shows two lower brackets 250 secured to each side 220 of trolley 212, any number of lower brackets may be secured to each side of the trolley. The lower brackets 250 secured to each side 220 of trolley 212 do not interfere with the movement of the ribbed strap 246 described below.

As best shown in FIGS. 1A and 3B, the rail system 24 has two ribbed straps 246, one per side. As shown in FIG. 1A, each of the two ribbed straps 246 has a smooth upper surface 258 and a ribbed lower surface 260 comprising spaced ribs 262. As shown in FIG. 1A, an anchor bracket 264 is secured to an upper flange 23 of one of the side rails 28 at each end (only one end being shown). Each anchor bracket 264 has a bottom 266 with grooves 268 adapted to receive and retain the spaced ribs 262 of the ribbed strap 246 and a top 270. As shown in FIG. 1A, the top 270 is secured to the bottom 266 with fasteners 272 with one of the ribbed straps 246 therebetween. Two anchor brackets 264 secure opposite ends of one of the ribbed straps 246 to one of the side rails 28 of the rail system 24.

As shown in FIG. 3B, each side of the trolley 212 further comprises two guide rollers 274 on opposite sides of the trolley wheel 218. Each of the guide rollers 274 is secured to the vertical wall 222 of one of the trolley sides 220. As illustrated in FIG. 3B, each one of the ribbed straps 248 extends above the upper flange 23 of one of the side rails 28 of the rail system 24, passes under the two guide rollers 274 and over the trolley wheel 218 which has teeth on the exterior thereof which engage the ribs 262 of the ribbed lower surface 260.

As best shown in FIGS. 3 and 5, the trolley 212 further comprises two shields 228, one per side. For ease of understanding, the shields 228 are omitted from FIG. 3B. As best shown in FIG. 3B, the trolley 212 further comprises four pegs 278, two being secured to each trolley side 220. As shown in FIG. 3B, each of the pegs 278 is secured to the vertical wall 222 of each trolley side 220 and adapted to fit into a portion of a shield 228 to secure the shield 228 in place. The pegs 278 secured to each side 220 of trolley 212 do not interfere with the movement of the ribbed strap 246 described below.

In operation, upon activation of the trolley motor 214 and rotation of the trolley shaft 216, the trolley wheels 218 rotate. Rotation of the trolley wheels 218 move the trolley 212 along above the rail system 24 due to the interaction between the trolley wheels 218 and the ribbed straps 246 secured to the side rails 28 of the rail system 24.

Figure 7:
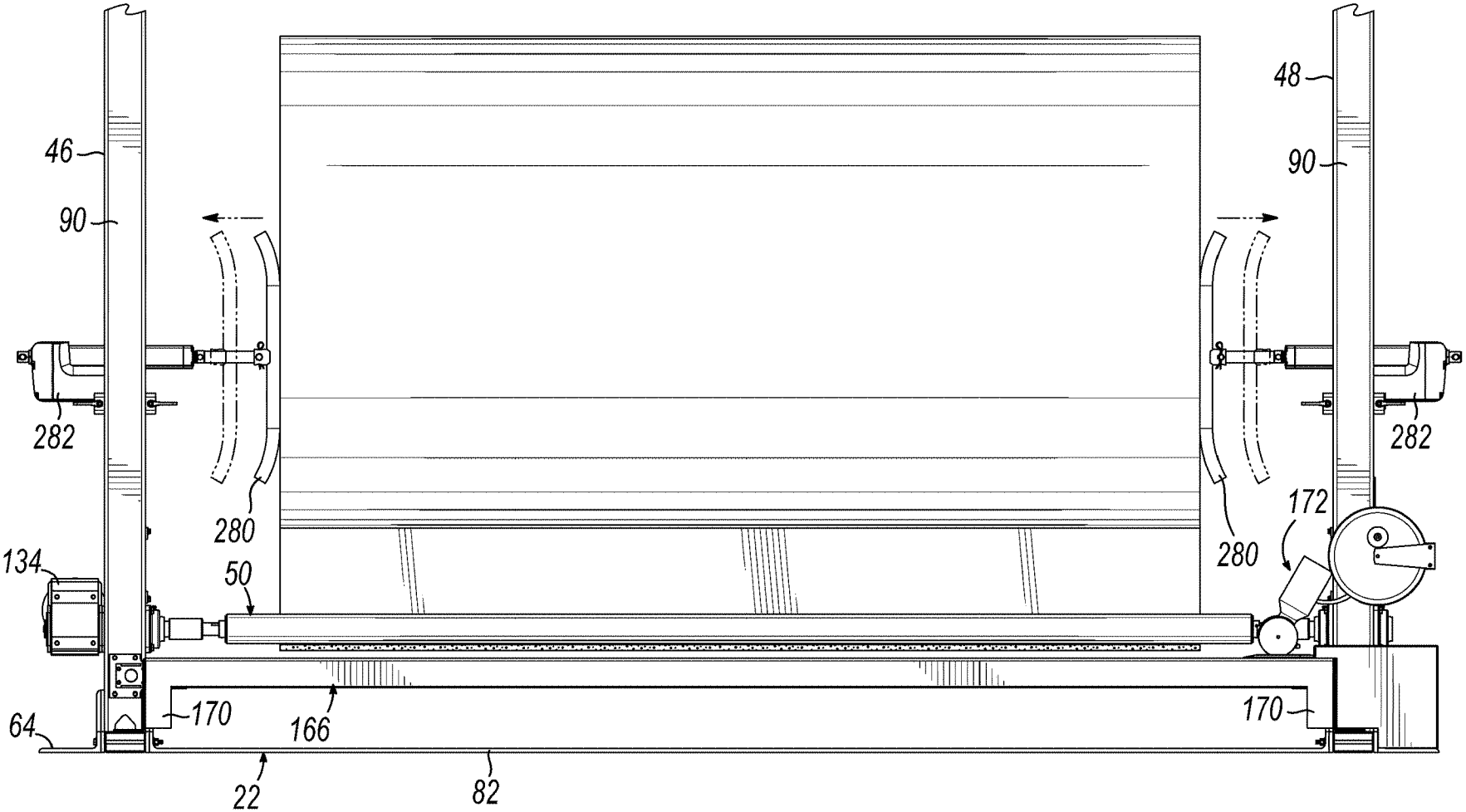
FIG. 7 is a rear elevational view of a portion of the apparatus of FIG. 1.

As shown in FIG. 7, the apparatus 10 further comprises two manually adjustable paddle brakes 280 per station, one on each side of a roll of material. The paddle brakes 280 apply friction to the outer side surfaces of the roll to slow the speed of rotation of the roll when in an active position shown in solid lines in FIG. 7. The paddle brakes 280 are in their inactive position as shown in dashed lines in FIG. 7 during times when a roll is being removed or inserted at a station in accordance with the present invention. The paddle brakes 280 are in a vertical orientation at all the feed stations, as shown in FIG. 7. However, at the loading station 34, the paddle brakes 280 are in a horizontal orientation to enable operators to more easily manually insert or remove a roll without having to lift a roll of replacement material over the paddle brakes 280 at the loading station 34. The paddle brakes 280 are moved by actuators 282 which are secured to the carriages 70 with angle brackets 284 shown in FIGS. 3D and 3E.

The method of replacing a roll of soft goods is shown in FIGS. 4A-4Q. FIG. 4A illustrates the replacement support 66 of the replacement roll 74 having been manually inserted into the nests 68 of the carriages 70 at the loading station 34. See arrow 78. The carriages 70 at the loading station 34 are at their lowered position making it easier for the operators to load the replacement roll 74 in place.

FIG. 4A illustrates the first support 100 residing in the nests 68 of the carriages 70 at the first feed station 36. The carriages 70 at the first feed station 36 are at their lowered position in which they stay during operation of the quilter 14. The trolley 212 is moving downstream as shown by arrow 286 from its home position illustrated in FIGS. 1 and 2 to a first cleared position in which the trolley 212 will not interfere with raising the carriages 70 at the loading station 34 to their raised position shown in FIG. 4B. During this movement the trolley 212 is empty, meaning there are no supports inside the front and rear support holders 238, 240. For purposes of this document the trolley 212 is referred to as a half-full trolley when a support is located only inside the front support holders 238, a half-empty trolley when a support is located inside only the rear support holders 240 and a fully loaded trolley when supports are in both the front and rear support holders 238, 240. In all instances, the trolley is referenced by number 212.

In FIG. 4A, the used roll 106 is shown having a smaller diameter than the replacement roll 74 because it has been used and is ready to be replaced using the apparatus 10 of the present invention. The cutting assembly 172 at the first feed station 36 has cut the web of first material 104 to create a trailing edge 288 on the web of first material 104 laying on the catwalk 166 at the first feed station 36.

Figure 4B:
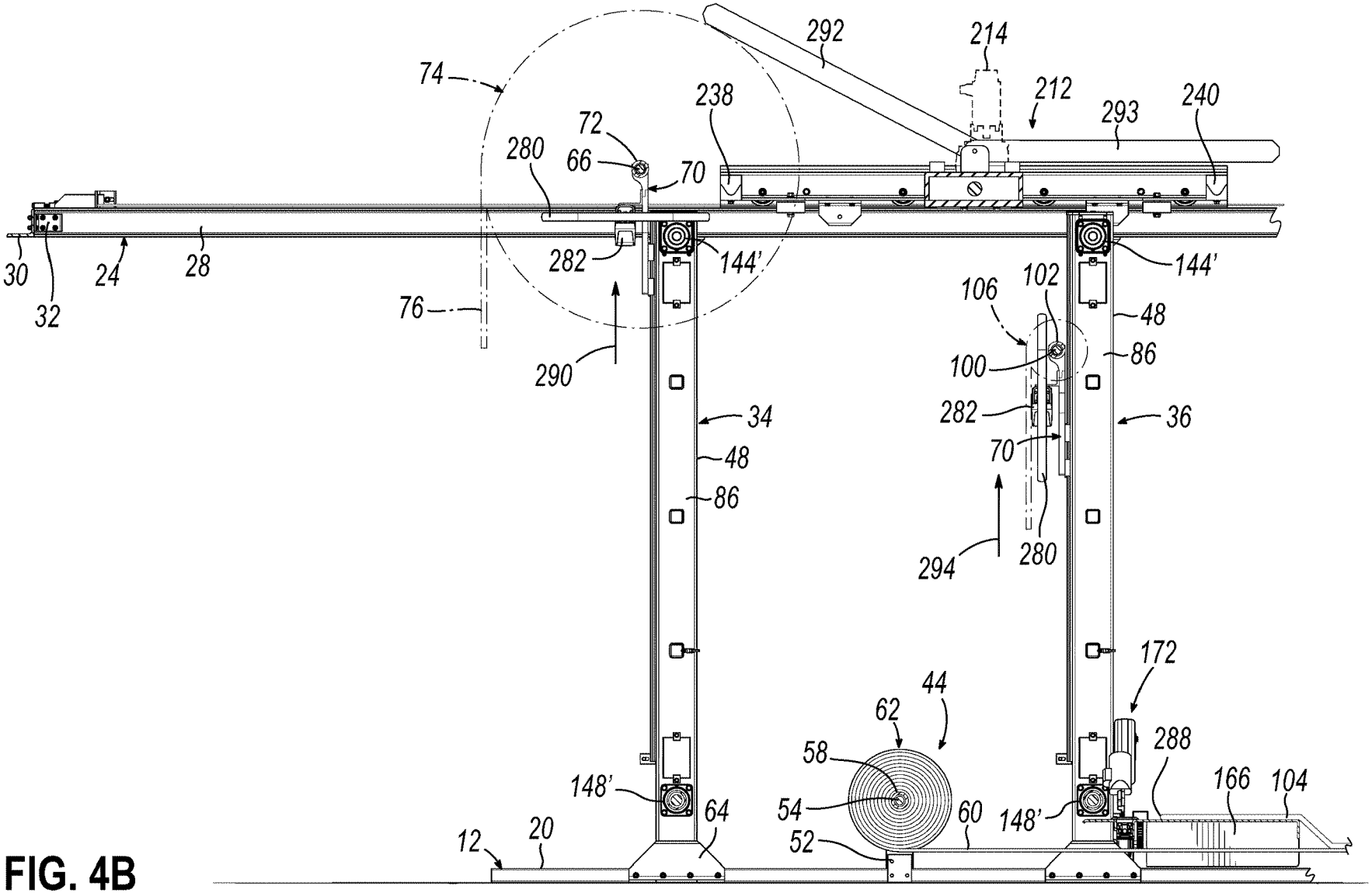
FIG. 4B is a side view of the portion of the apparatus shown in FIG. 3 showing the replacement support being lifted to a raised position at the loading station.

FIG. 4B illustrates the empty trolley 212 in the same first cleared position shown in FIG. 4A. FIG. 4B shows the carriages 70 being raised by lifting assembly 132 at the loading station 34 to their raised position in which the replacement support 66 sits inside downwardly extending generally U-shaped nests 68 in carriages 70 above the rail system 24. See arrow 290. When the replacement support 66 supporting the replacement roll 74 is in this raised position, weighted front arms 292 of the trolley 212 are pushed up against the replacement roll 74. The contact between the weighted front arms 292 and replacement roll 74 prevents the web of replacement material 76 from unraveling off the replacement roll 74. While the lifting assembly 132 at the loading station 34 is raising the replacement roll 74, the lifting assembly 132 at the first feed station 36 is simultaneously raising the used roll 106 to a staged position. See arrow 294.

Figure 4C:
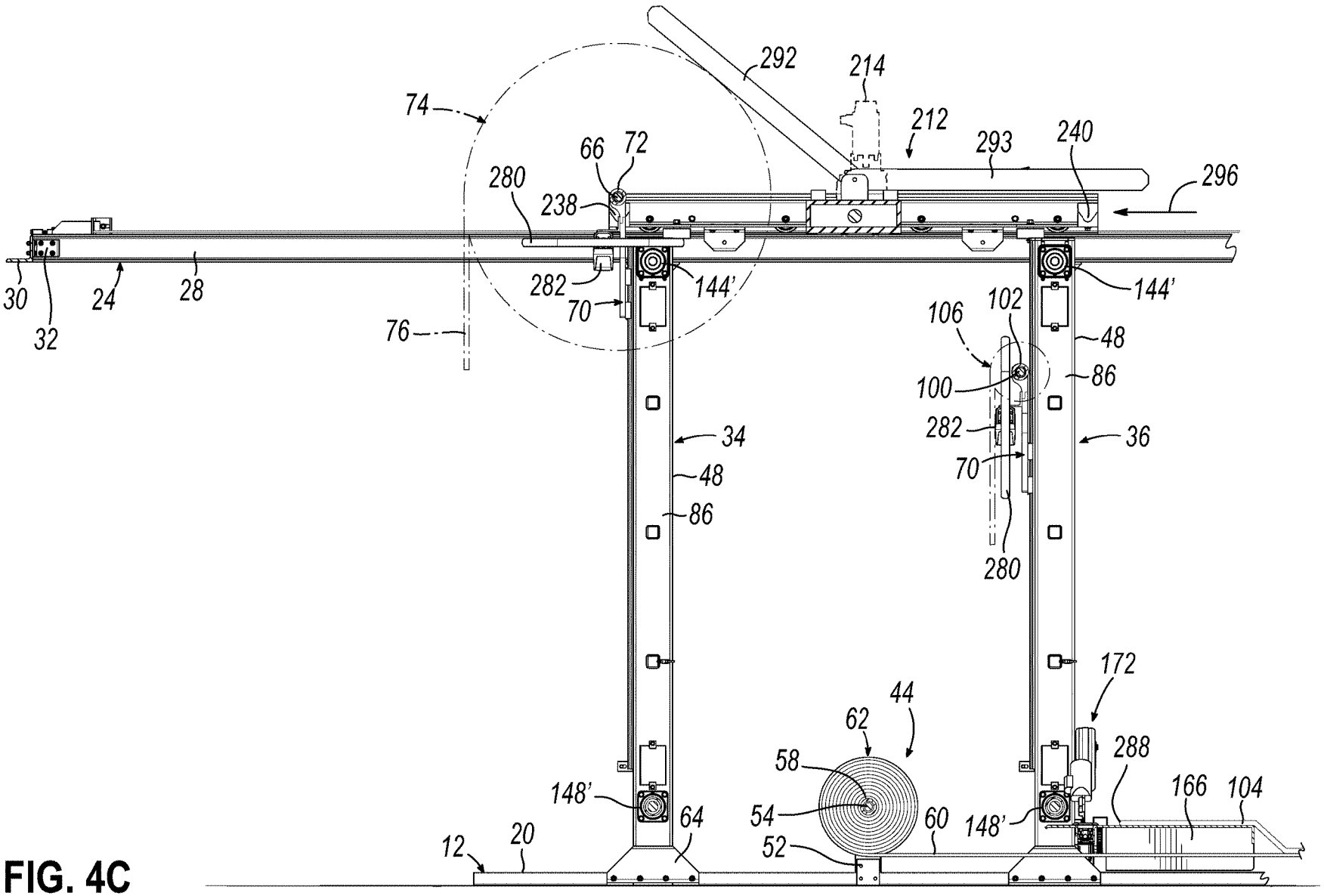
FIG. 4C is a side view of the portion of the apparatus shown in FIG. 3 showing the replacement support in its raised position at the loading station and the trolley moving upstream to a loading position.

FIG. 4C illustrates the empty trolley 212 moving upstream from its position shown in FIGS. 4A and 4B to a first loading position in which the front support holders 238 (only one being shown) are underneath the ends of the replacement support 66 of the replacement roll 74. See arrow 296. During this upstream movement of the empty trolley, the replacement support 66 of the replacement roll 74 does not move from its raised position shown in FIG. 4B. Likewise, the first support 100 of the used roll 106 does not move from its staged position shown in FIG. 4B.

Figure 4D:
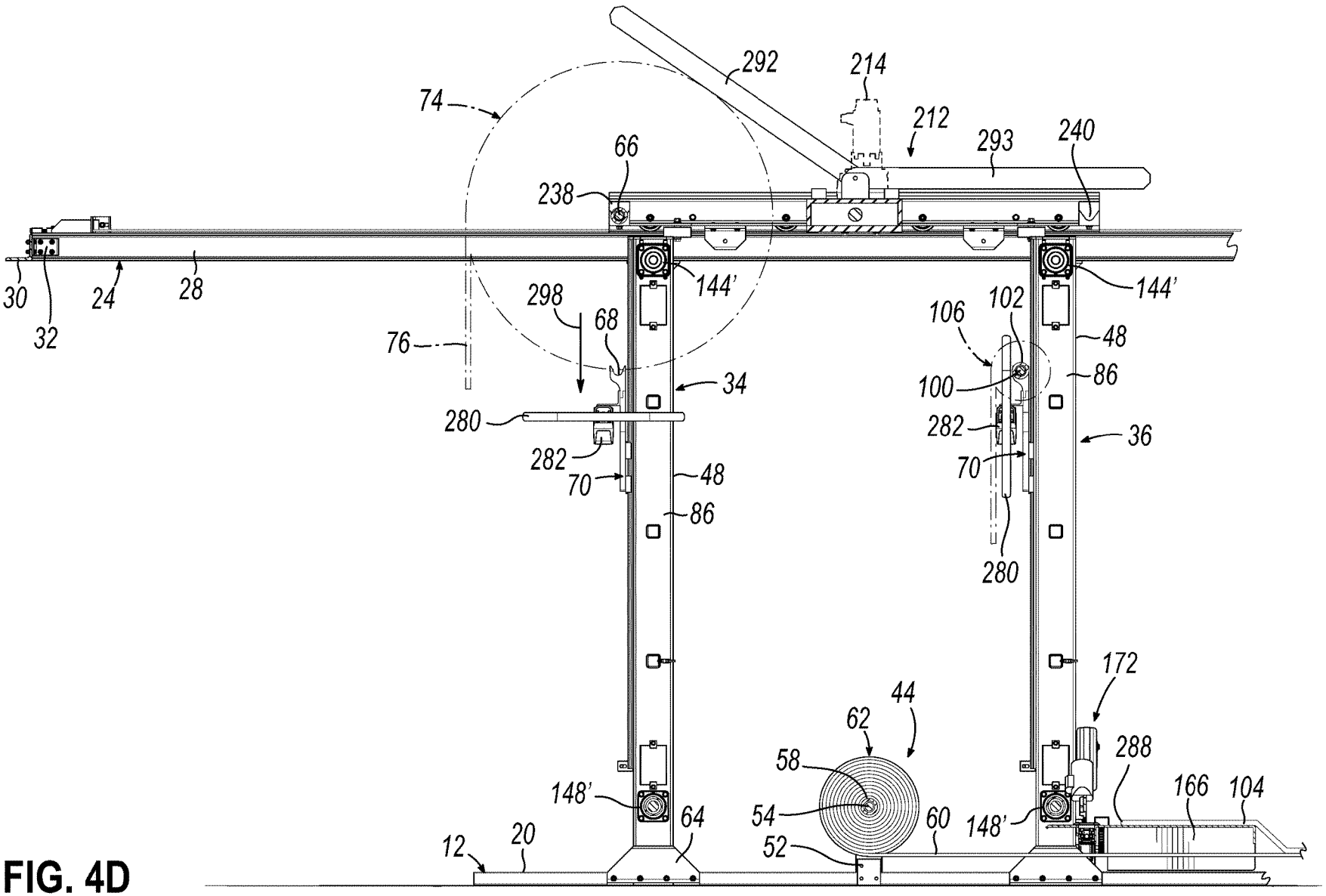
FIG. 4D is a side view of the portion of the apparatus shown in FIG. 3 showing the replacement support being inside the front support holders of the trolley and the carriages at the loading station being lowered.

FIG. 4D illustrates the carriages 70 at the loading station 34 being lowered by the lifting assembly 132 at the loading station 34 as shown by the arrow 298 to a staged position while the trolley 212 remains in its first loading position shown in FIG. 4C. The ends of the replacement support 66 of the replacement roll 74 come to rest in the dips 242 of the front support holders 238, thus creating a half-loaded trolley 212. During this downward movement of the carriages 70 at the loading station 34, the first support 100 of the used roll 106 does not move from its staged position shown in FIG. 4B.

Figure 4E:
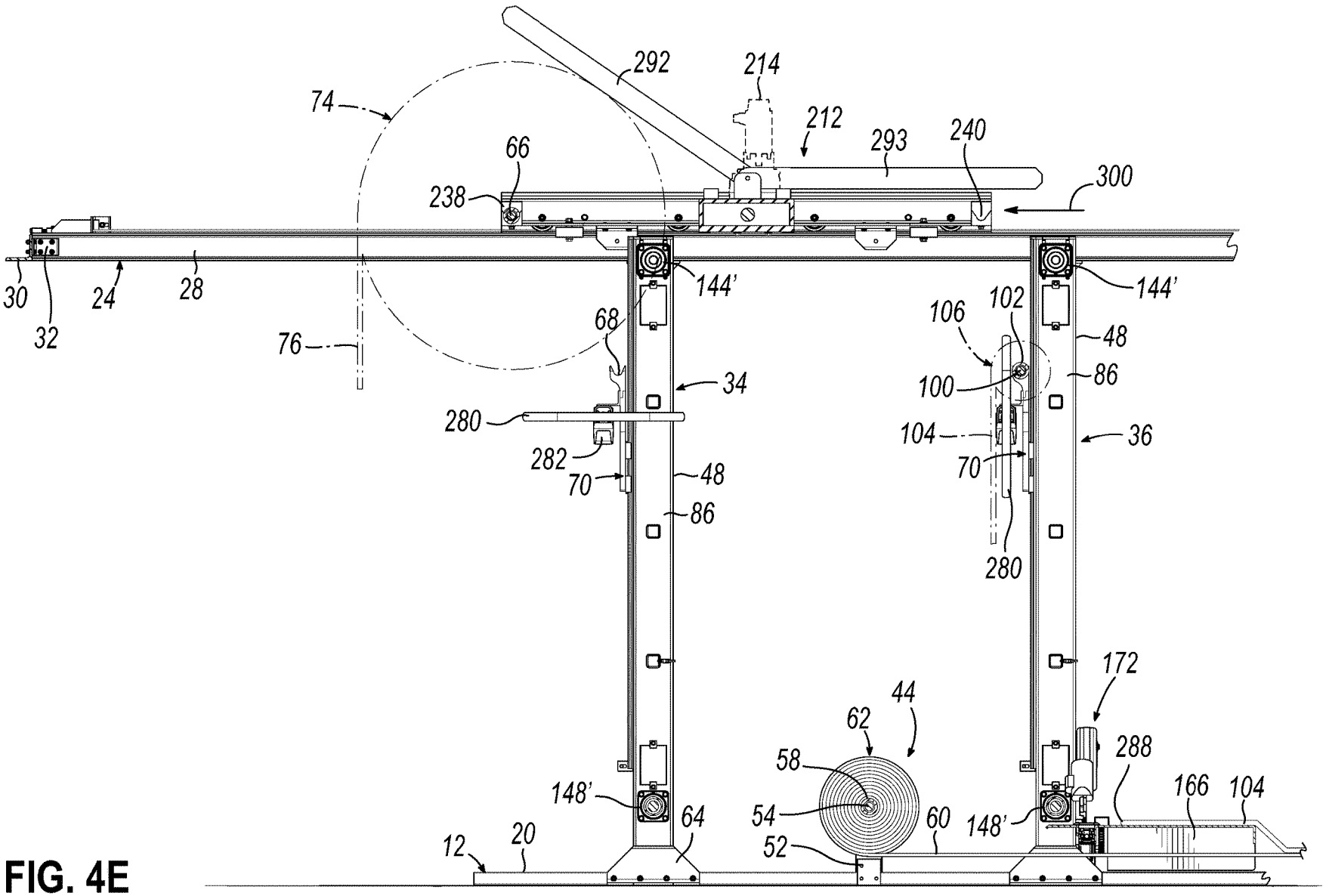
FIG. 4E is a side view of the portion of the apparatus shown in FIG. 3 showing the trolley moving upstream with the first support inside the front support holders of the trolley so the trolley does not interfere with raising the carriages at the first feed station.
Figure 4F:
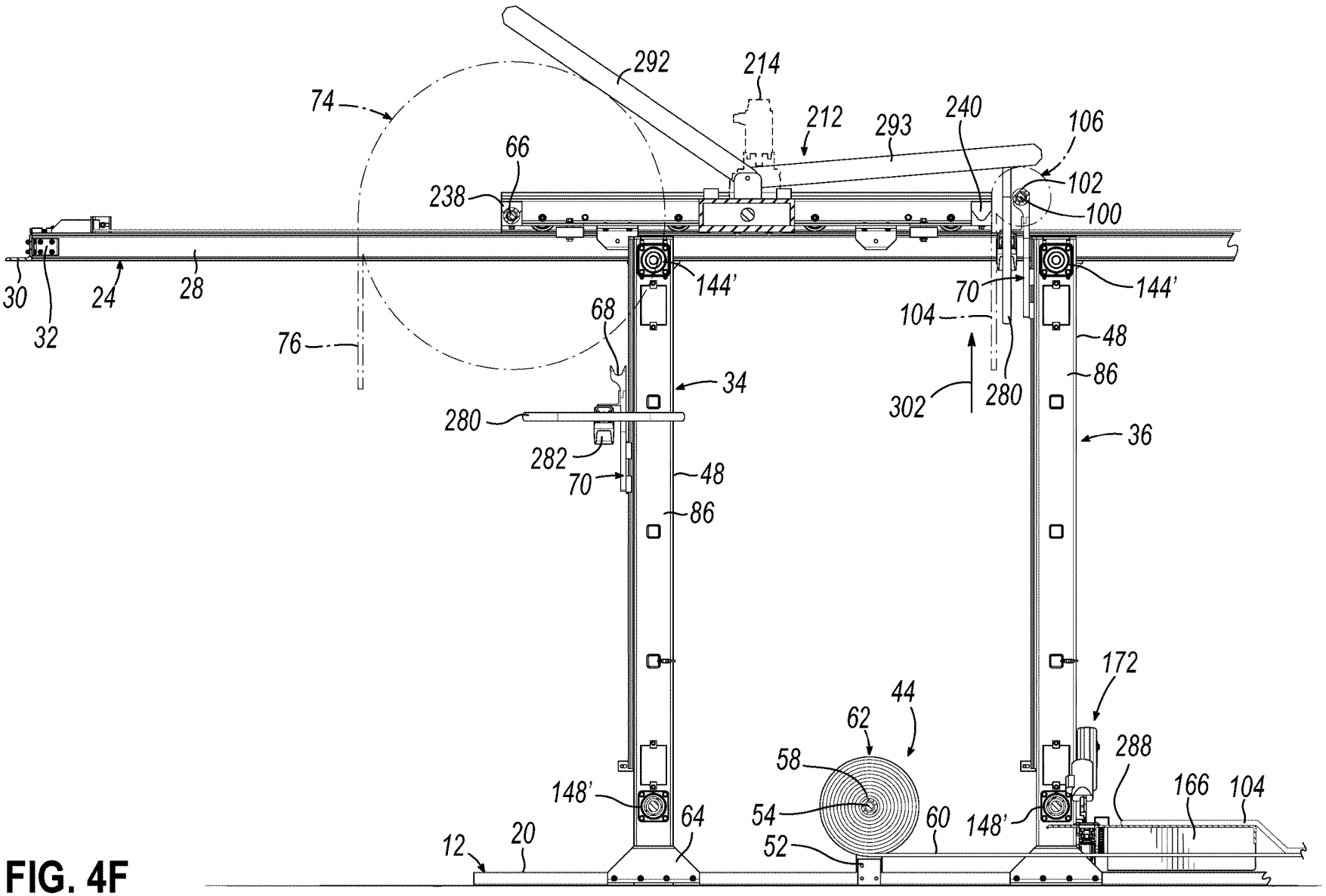
FIG. 4F is a side view of the portion of the apparatus shown in FIG. 3 showing the trolley in the same position shown in FIG. 4E with the replacement support inside the front support holders of the trolley and the carriages at the first feed station being raised to their raised position.

FIG. 4E illustrates the half-loaded trolley 212 moving upstream from its first loading position shown in FIG. 4D to a second cleared position upstream of a second loading position shown in FIG. 4F. See arrow 300. In this second cleared position, the front support holders 238 (only one being shown) of the half-loaded trolley 212 support the ends of the replacement support 66 of the replacement roll 74 and the replacement roll 74 travels upstream with the half-loaded trolley 212. During this upstream movement of the half-loaded trolley 212, the first support 100 of the used roll 106 does not move from its staged position shown in FIG. 4E.

FIG. 4F illustrates the half-loaded trolley 212 still in its second cleared position shown in FIG. 4E. In its second cleared position the half-loaded trolley 212 will not interfere with raising the carriages 70 at the first feed station 36 to their raised position shown in FIG. 4F. FIG. 4F shows the carriages 70 being raised by lifting assembly 132 at the first feed station 36 to their raised position in which the first support 100 is above the rail system 24. See arrow 302. When the first support 100 supporting the used roll 106 is in this raised position, weighted rear anus 293 of the trolley 212 are pushed up against the used roll 106. The contact between the weighted rear arms 293 and used roll 106 prevents the web of first material 104 from unraveling off the used roll 106. While the lifting assembly 132 at the first feed station 36 is raising the used roll 106, the lifting assembly 132 at the loading station 34 is idle.

Figure 4G:
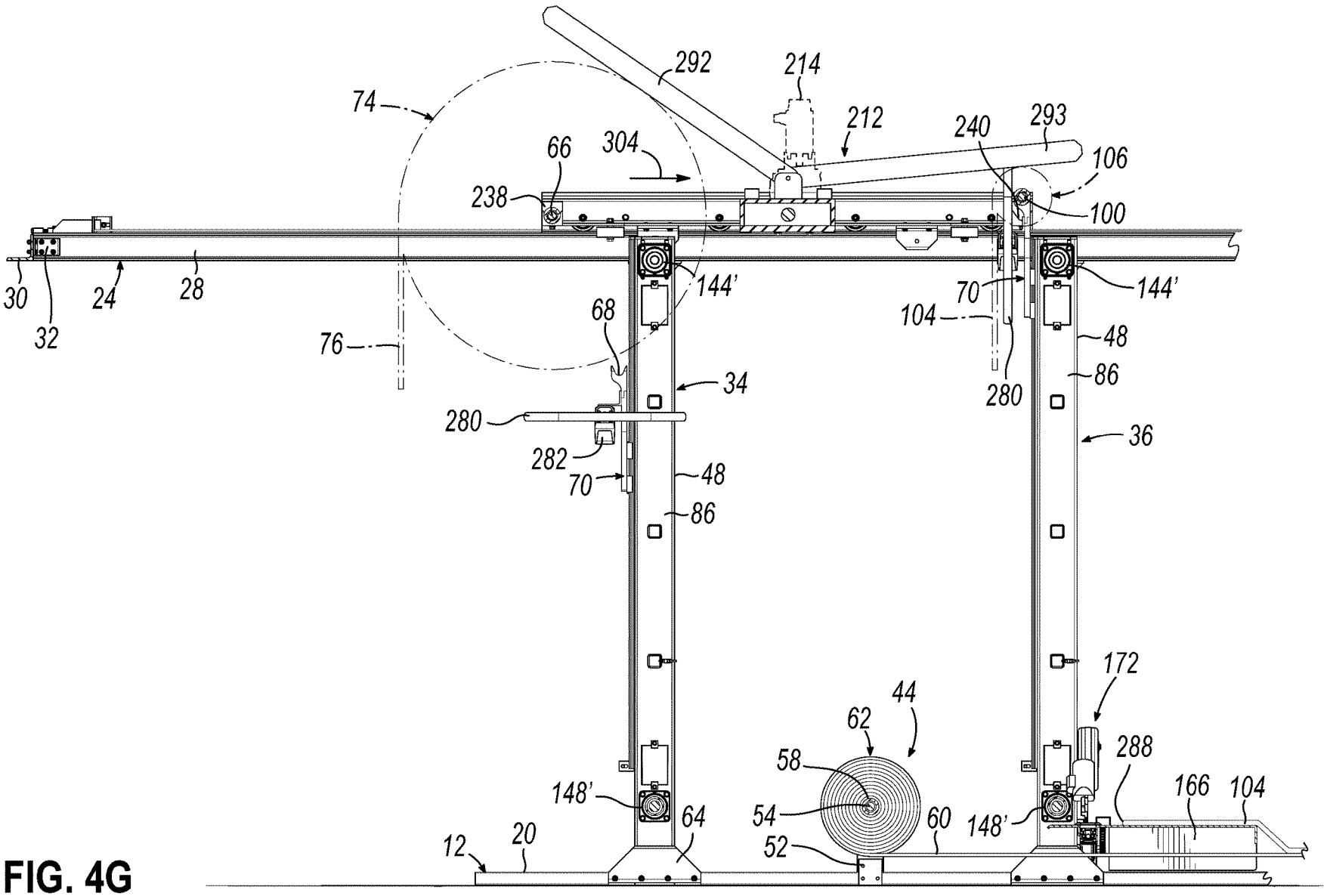
FIG. 4G is a side view of the portion of the apparatus shown in FIG. 3 showing the trolley moving downstream to a second loading position in which the first support is directly above the rear support holders of the trolley at the first feed station.

FIG. 4G illustrates the half-loaded trolley 212 having moved downstream from its second cleared position shown in FIGS. 4E and 4F to its second loading position as shown by arrow 304. In its second loading position, the rear support holders 240 (only one being shown) of the half-loaded trolley 212 are underneath the ends of the first support 100 of the used roll 106. During this downstream movement of the half-loaded trolley 212, the replacement support 66 of the replacement roll 74 remains inside the dips 242 of the front support holders 238.

Figure 4H:
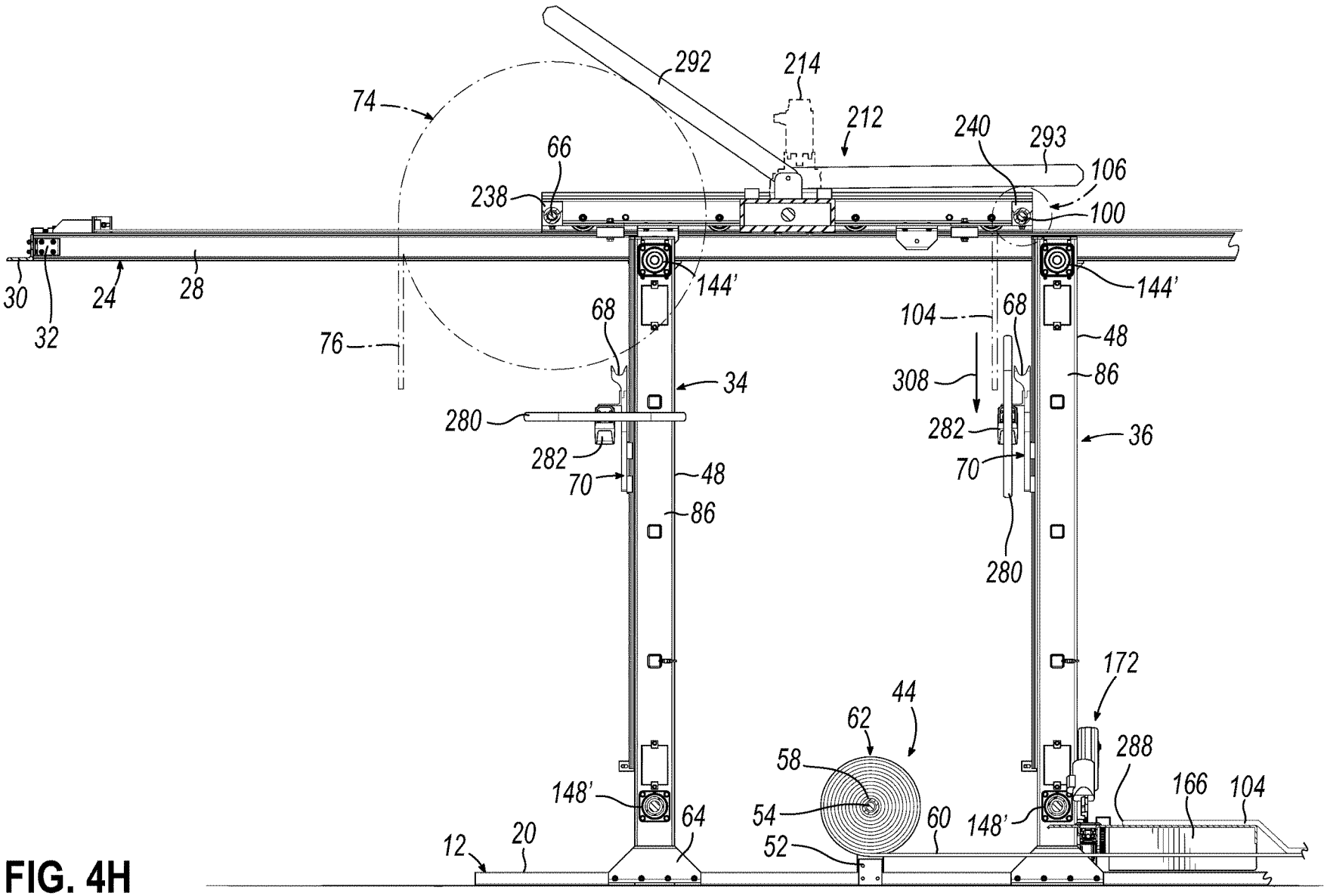
FIG. 4H is a side view of the portion of the apparatus shown in FIG. 3 showing the first support being inside the rear support holders of the trolley to create a fully loaded trolley and the carriages at the first feed station being lowered.

FIG. 4H illustrates the carriages 70 at the first feed station 36 being lowered by the lifting assembly 132 at the first feed station 36 as shown by the arrow 308 to a staged position while the half-loaded trolley 212 remains in its second loading position shown in FIG. 4G. The ends of the first support 100 of the used roll 106 come to rest in the dips 242 of the rear support holders 240, thus creating a fully-loaded trolley 212. During this downward movement of the carriages 70 at the first feed station 36, the replacement support 66 of the replacement roll 94 remains inside the dips 242 of the front support holders 238 of the fully-loaded trolley 212.

Figure 4I:
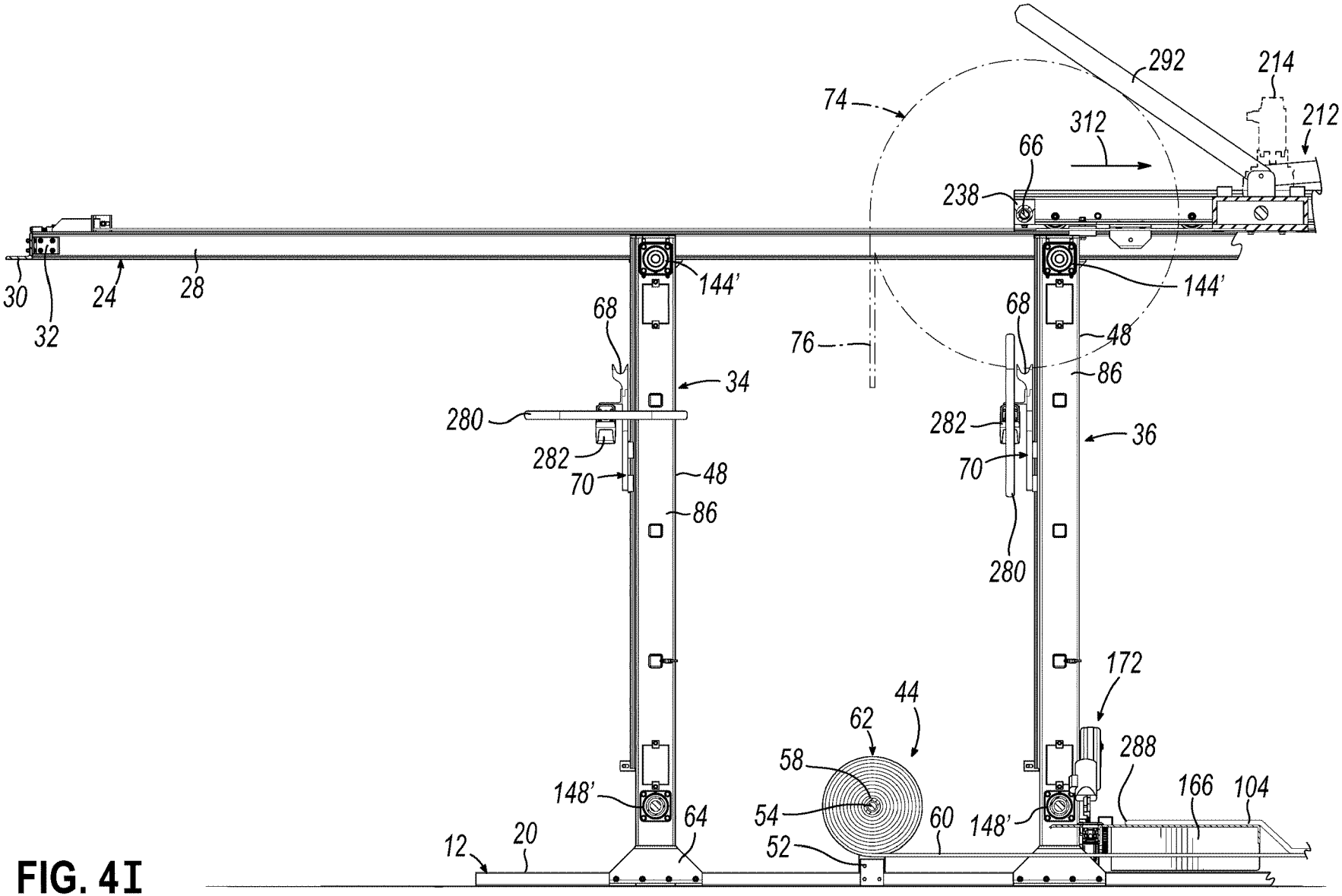
FIG. 4I is a side view of the portion of the apparatus shown in FIG. 3 showing the fully loaded trolley moving downstream to a first unloading position in which the replacement support in the front support holders of the trolley is directly above the carriages at the first feed station.

FIG. 4I illustrates the fully-loaded trolley 212 moving rearwardly or downstream from its second loading position to a first unloading position. See arrow 312. In its first unloading position, the front support holders 238 of the fully-loaded trolley 212 are above the generally U-shaped nests 68 in carriages 70 of the first feed station 36.

Figure 4J:
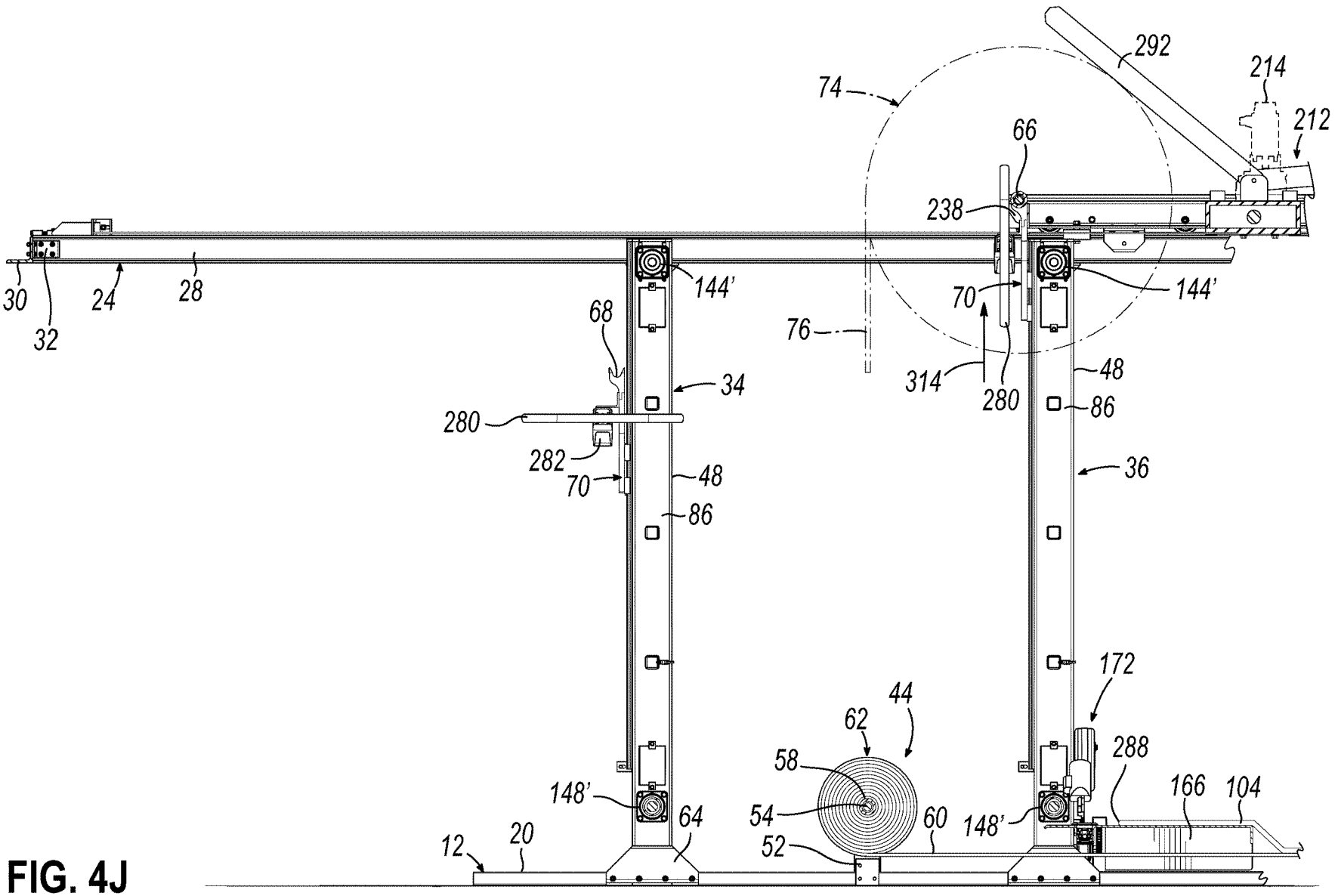
FIG. 4J is a side view of the portion of the apparatus shown in FIG. 3 showing the fully loaded trolley in the same first unloading position shown in FIG. 4I with the replacement support inside the front support holders of the trolley and showing the carriages at the first feed station being raised to their raised position, thus lifting the replacement support out of the front support holders of the trolley.

FIG. 4J illustrates the fully-loaded trolley 212 still in its first unloading position shown in FIG. 4I. FIG. 4J shows the carriages 70 being raised by lifting assembly 132 at the first feed station 36 to their raised position, thereby capturing the ends of the replacement support 66 in the generally U-shaped nests 68 in carriages 70 and further raising the carriages 70 at the first feed station 36 so the replacement support 66 is above the rail system 24. See arrow 314. When the replacement support 66 supporting the replacement roll 74 is in this raised position, weighted front arms 292 of the trolley 212 are pushed up against the replacement roll 74. The contact between the weighted front arms 292 and replacement roll 74 prevents the web of replacement material 76 from unraveling off the replacement roll 74. While the lifting assembly 132 at the first feed station 36 is raising the replacement roll 74, the lifting assembly 132 at the loading station 34 is idle.

Figure 4K:
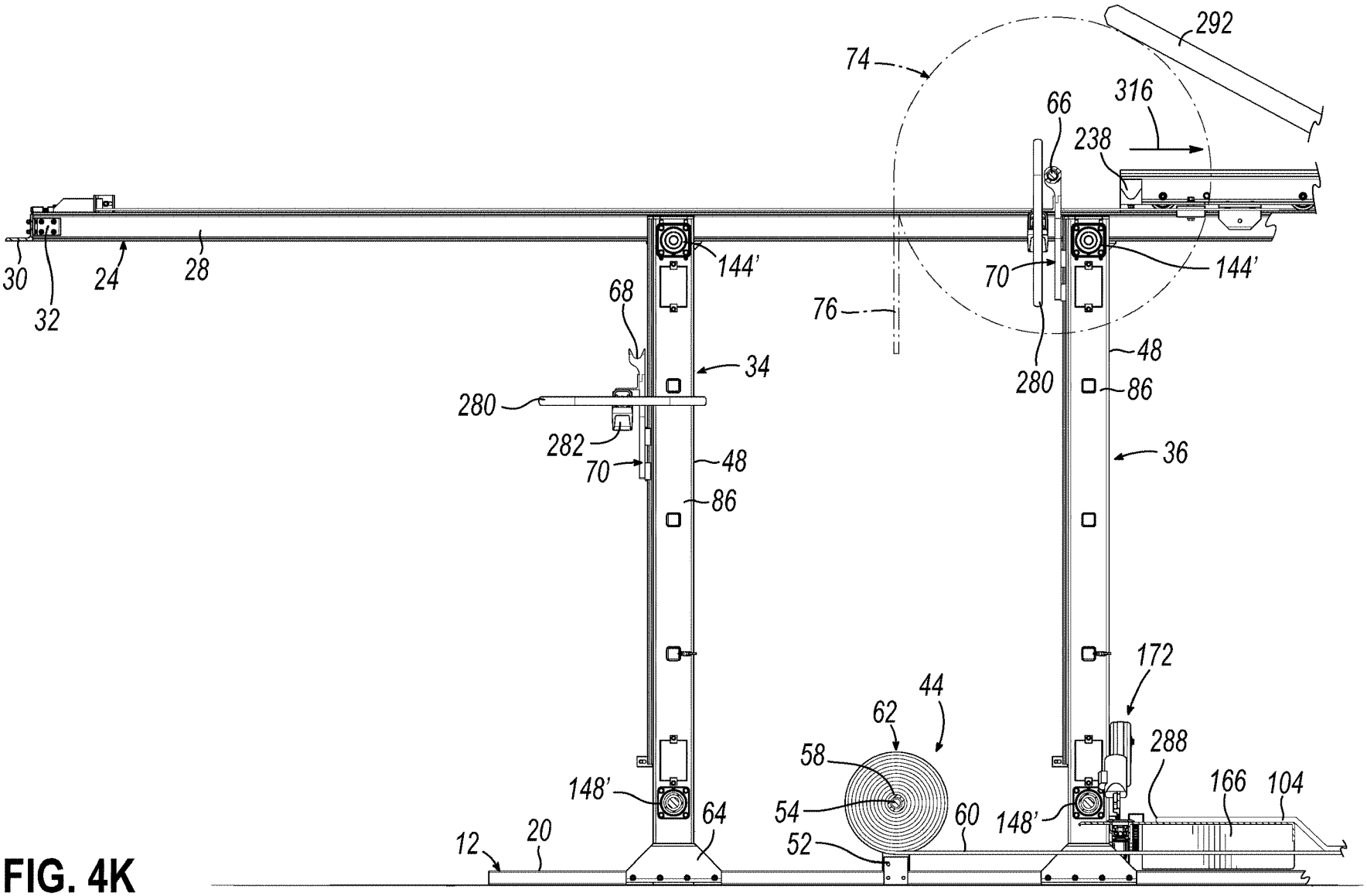
FIG. 4K is a side view of the portion of the apparatus shown in FIG. 3 showing the trolley moving downstream from the first unloading position with the replacement support inside the carriages at the first feed station, the carriages at the first feed station being in their raised position.

FIG. 4K illustrates the replacement support 66 of replacement roll 74 residing in the nests 68 of the carriages 70 at the first feed station 36. The carriages 70 at the first feed station 36 are in their raised position. The trolley 212 is moved downstream as shown by arrow 316 from its first unloading position illustrated in FIG. 4I to a rearmost position in which the trolley 212 will not interfere with lowering the carriages 70 at the first feed station 36 to their lowered position shown in FIG. 4L. During this downstream movement the trolley 212 is half-empty, meaning there are no supports inside the front support holders 238.

Figure 4L:
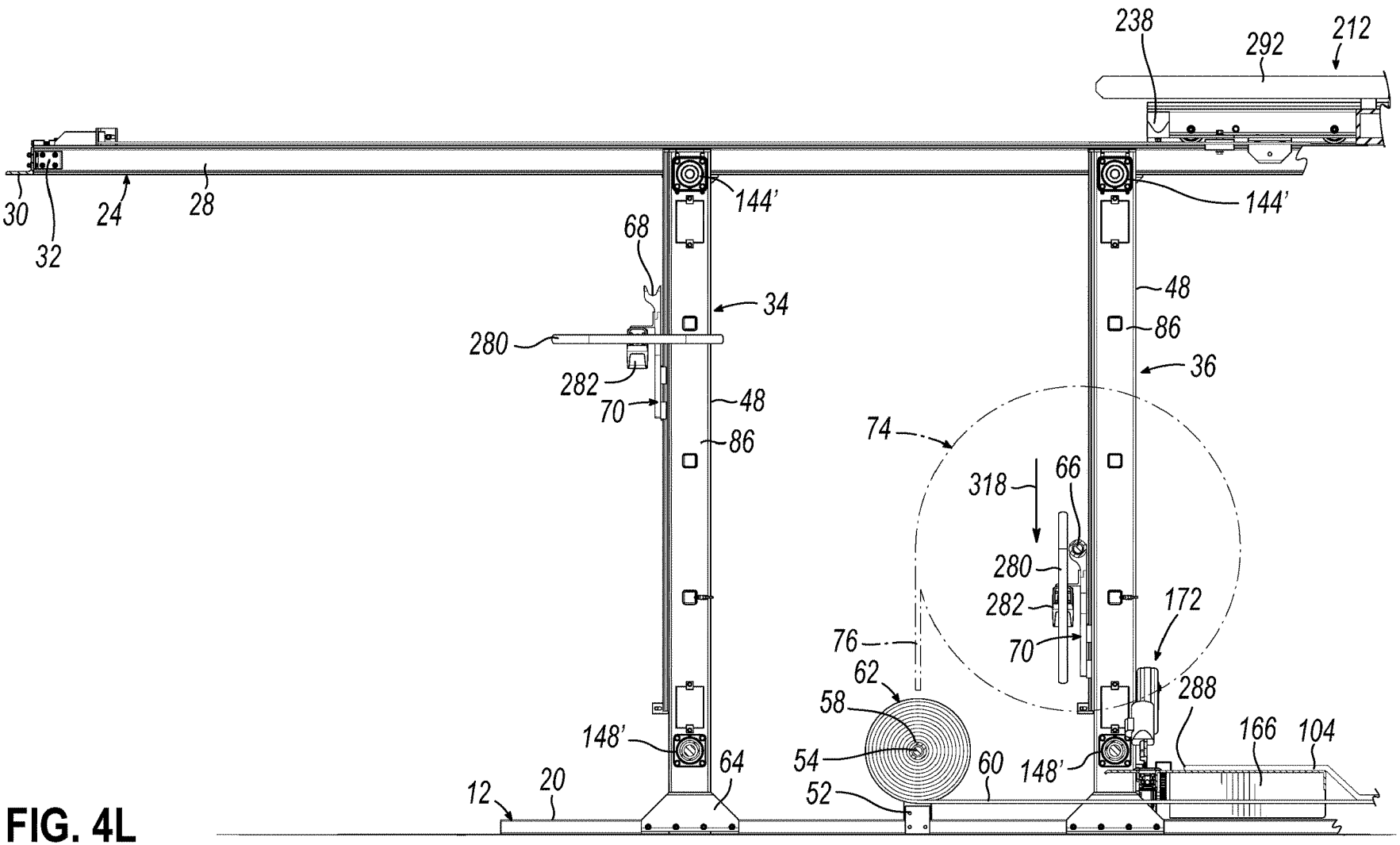
FIG. 4L is a side view of the portion of the apparatus shown in FIG. 3 showing the trolley in its rearmost position downstream from its first unloading position, the carriages at the first feed station lowering the replacement support to a lowered position.

FIG. 4L illustrates the carriages 70 at the first feed station 36 being lowered by the lifting assembly 132 at the first feed station 36 as shown by the arrow 318 to a lowered position while the half-empty trolley 212 remains in its rearmost position shown in FIG. 4K.

Figure 4M:
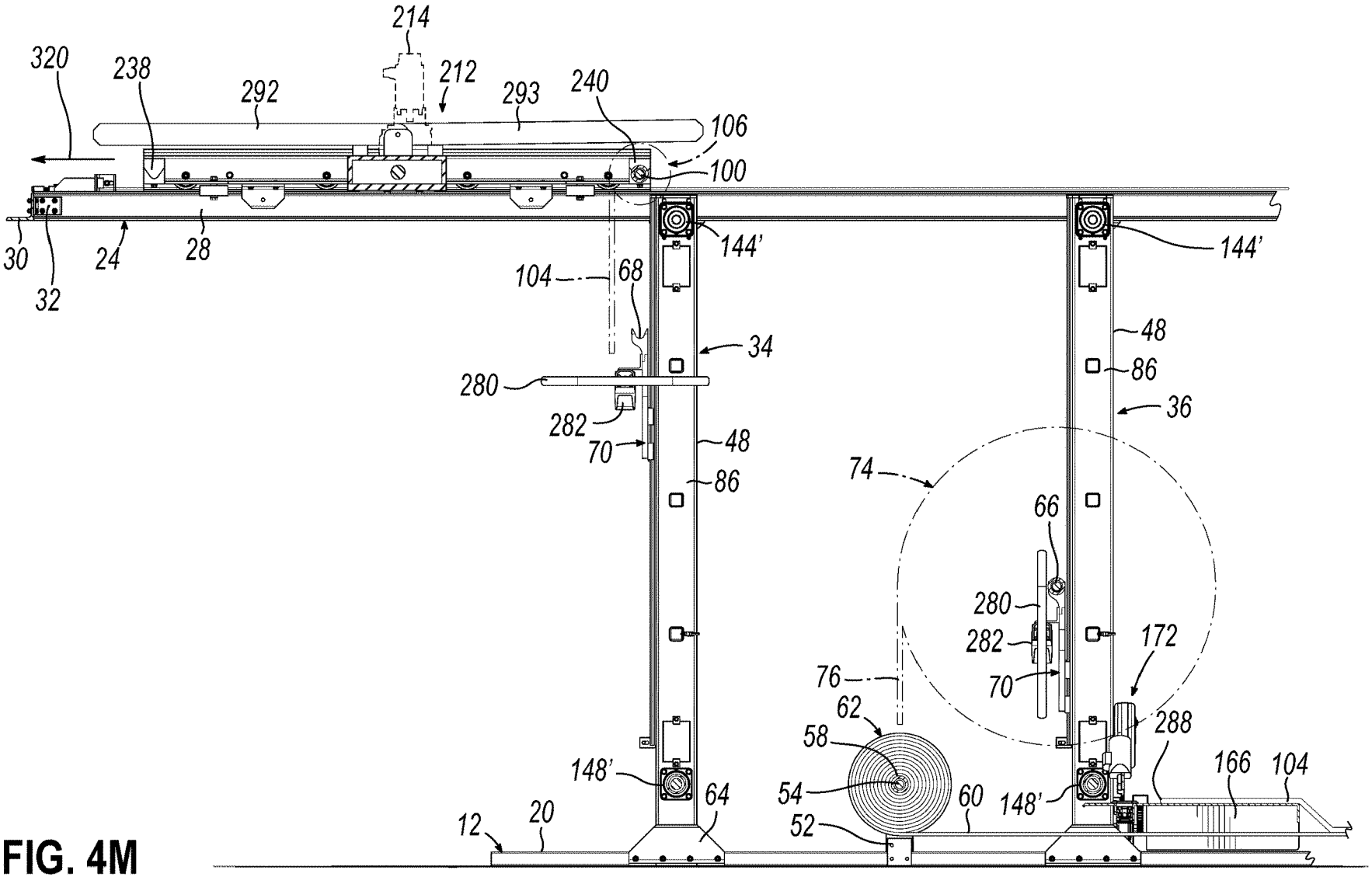
FIG. 4M is a side view of the portion of the apparatus shown in FIG. 3 showing the trolley moving upstream to its second unloading position with the first support inside the carriages at the loading station, the carriages at the loading station being raised from their lowered position.

FIG. 4M illustrates the half-empty trolley 212 moving upstream from its rearmost position shown in FIG. 4L to a second unloading position. See arrow 320. In this second unloading position, the rear support holders 240 (only one being shown) of the half-empty trolley 212 are above the generally U-shaped nests 68 in carriages 70 of the loading station 34.

Figure 4N:
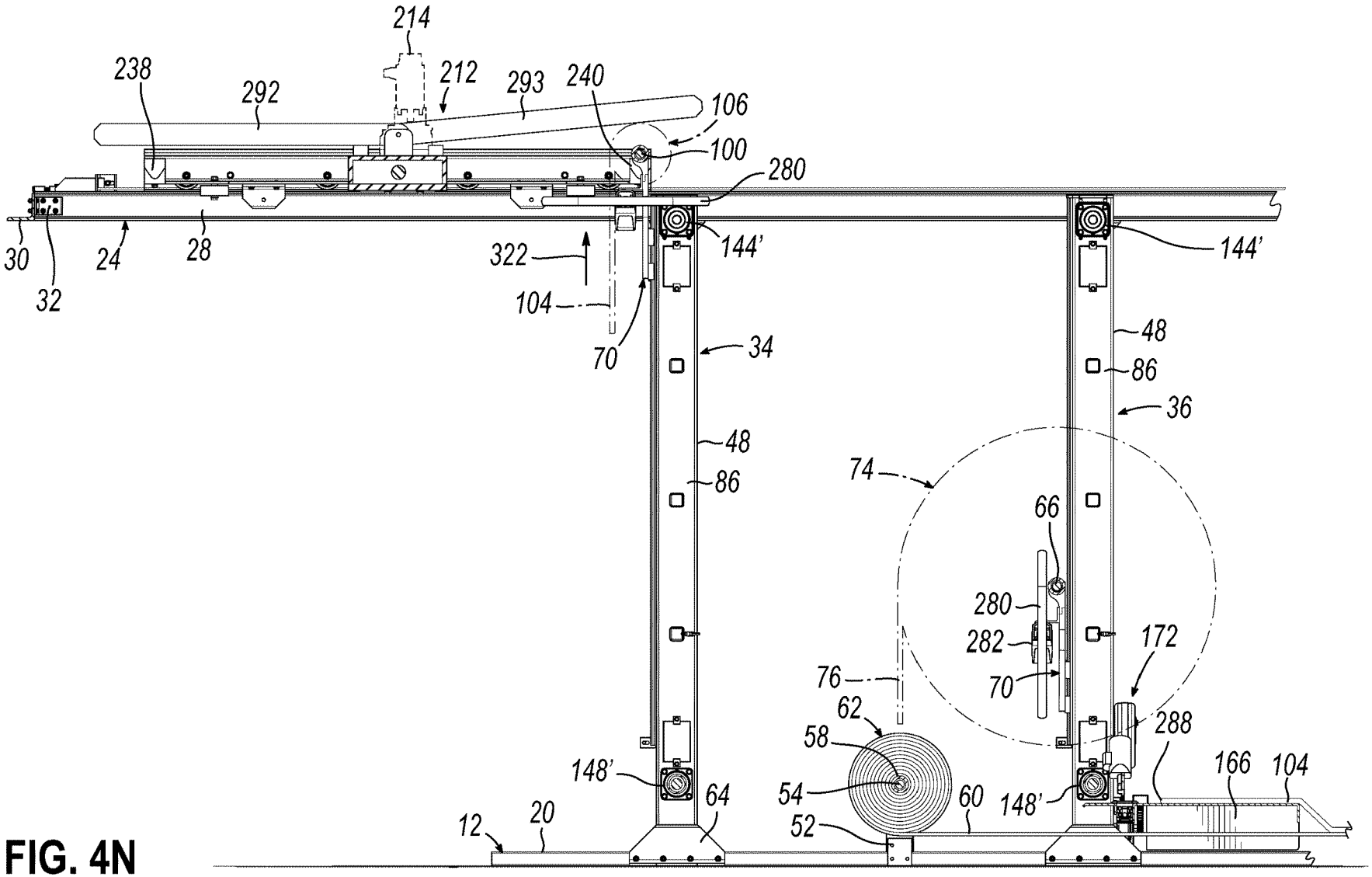
FIG. 4N is a side view of the portion of the apparatus shown in FIG. 3 showing the trolley in the same second unloading position shown in FIG. 4M with the first support inside the rear support holders of the trolley and showing the carriages at the loading station being raised to their raised position, thus lifting the first support out of the rear support holders of the trolley.

FIG. 4N illustrates the half-empty trolley 212 still in its second unloading position shown in FIG. 4M. FIG. 4N shows the carriages 70 being raised by lifting assembly 132 at the loading station 34 to their raised position, thereby capturing the ends of the first support 100 in the generally U-shaped nests 68 in carriages 70 and further raising the carriages 70 at the loading station 34 so the first support 100 is above the rail system 24. See arrow 322. When the first support 100 supporting the used roll 106 is in this raised position, weighted rear arms 293 of the trolley 212 are pushed up against the used roll 106. The contact between the weighted rear arms 293 and used roll 106 prevents the web of first material 104 from unraveling off the used roll 106. While the lifting assembly 132 at the loading station 34 is raising the used roll 106, the lifting assembly 132 at the first feed station 36 is idle.

Figure 4O:
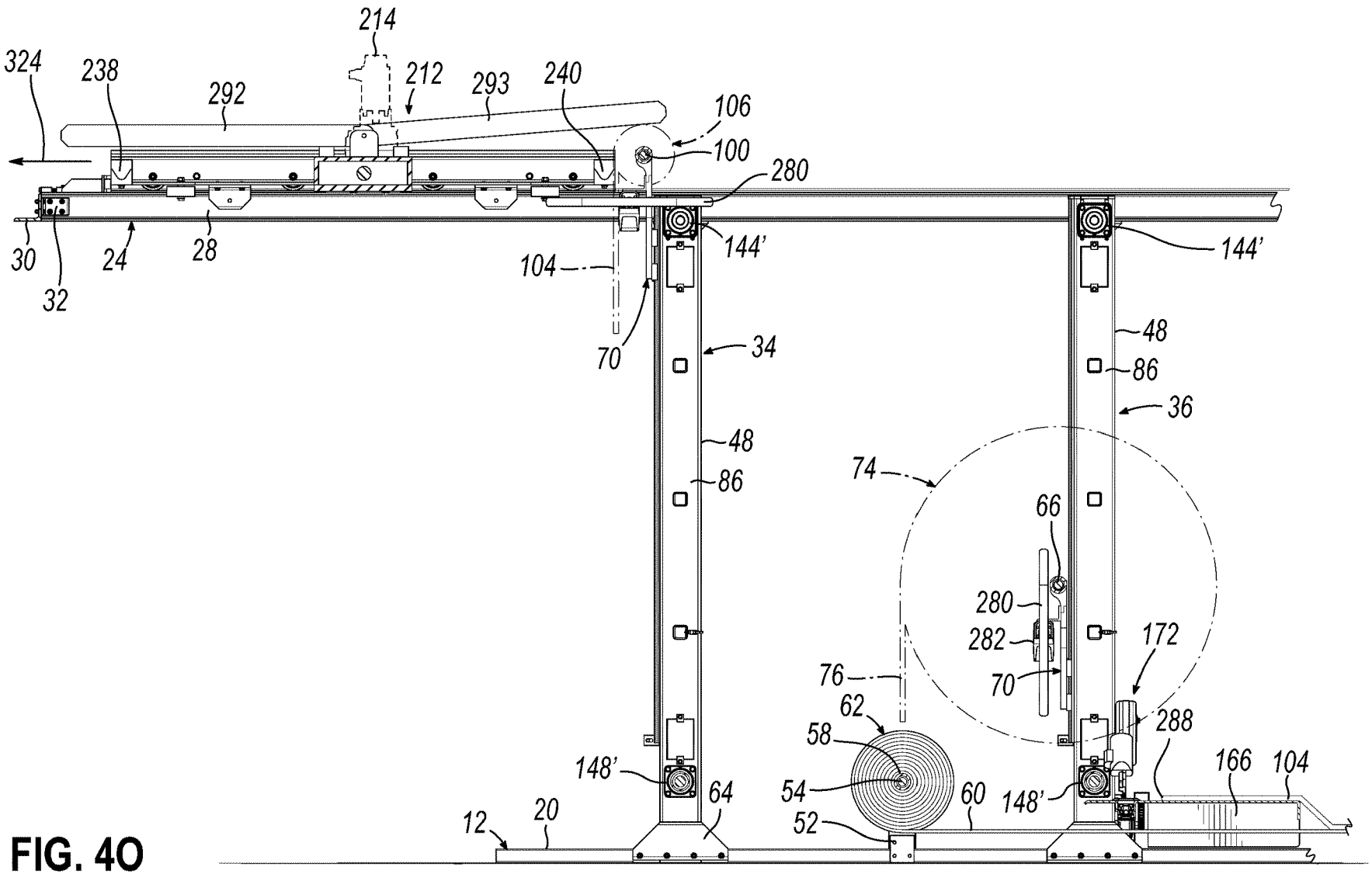
FIG. 4O is a side view of the portion of the apparatus shown in FIG. 3 showing the trolley moving upstream from its second unloading position with the first support inside the carriages at the loading station, the carriages at the loading station being in their raised position.

FIG. 4O illustrates the first support 100 of used roll 106 residing in the nests 68 of the carriages 70 at the loading station 34. The carriages 70 at the loading station 34 are in their raised position. The trolley 212 is moved upstream as shown by arrow 324 from its second unloading position illustrated in FIG. 4N to a third cleared position in which the trolley 212 will not interfere with lowering the carriages 70 at the loading station 34 to their lowered position shown in FIG. 4P. During this downstream movement the trolley 212 is empty, meaning there are no supports inside the support holders 238, 240.

Figure 4P:
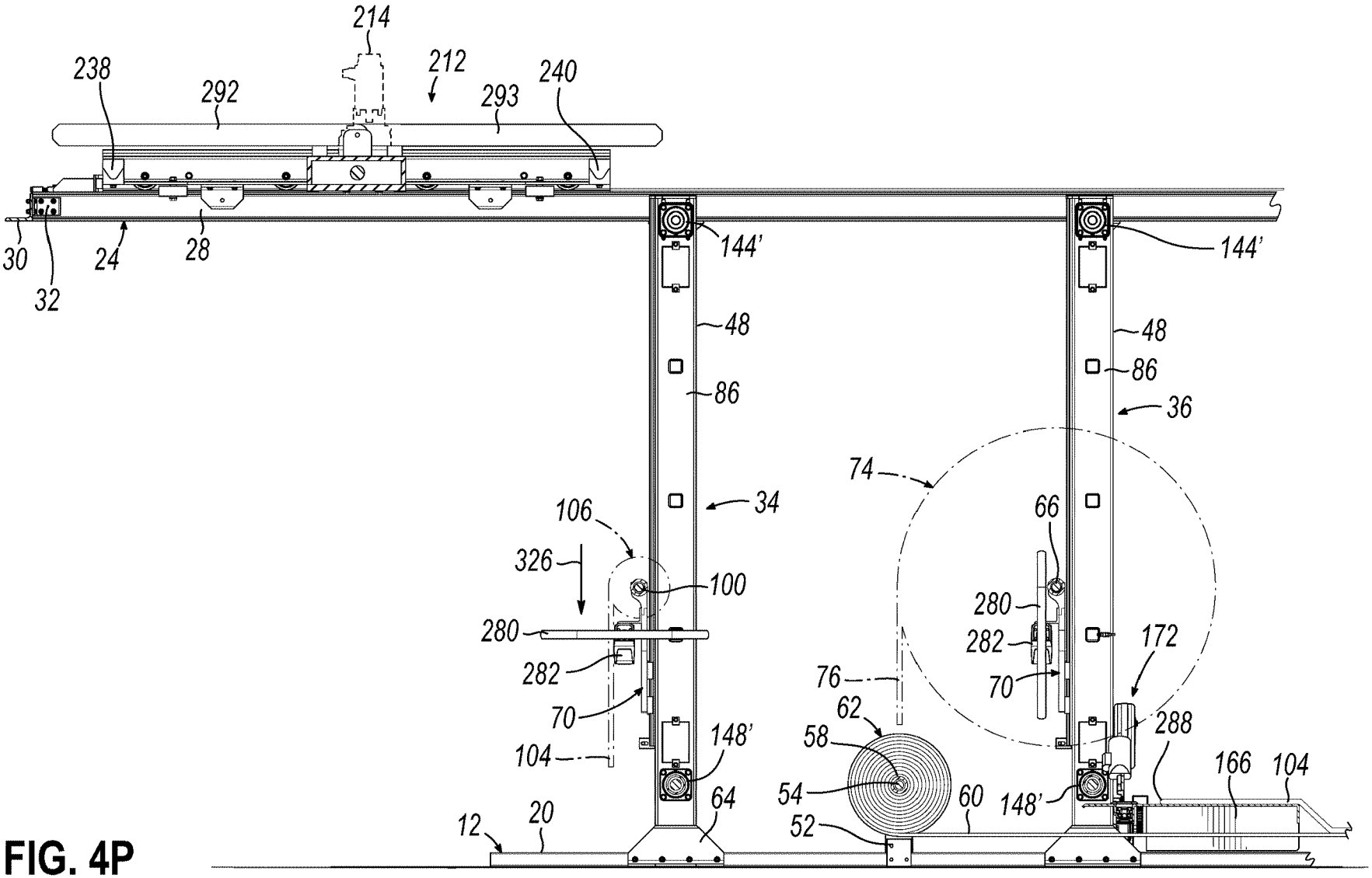
FIG. 4P is a side view of the portion of the apparatus shown in FIG. 3 showing the trolley in its home position upstream from its second unloading position, the carriages at the loading station lowering the first support to a lowered position.
Figure 4Q:
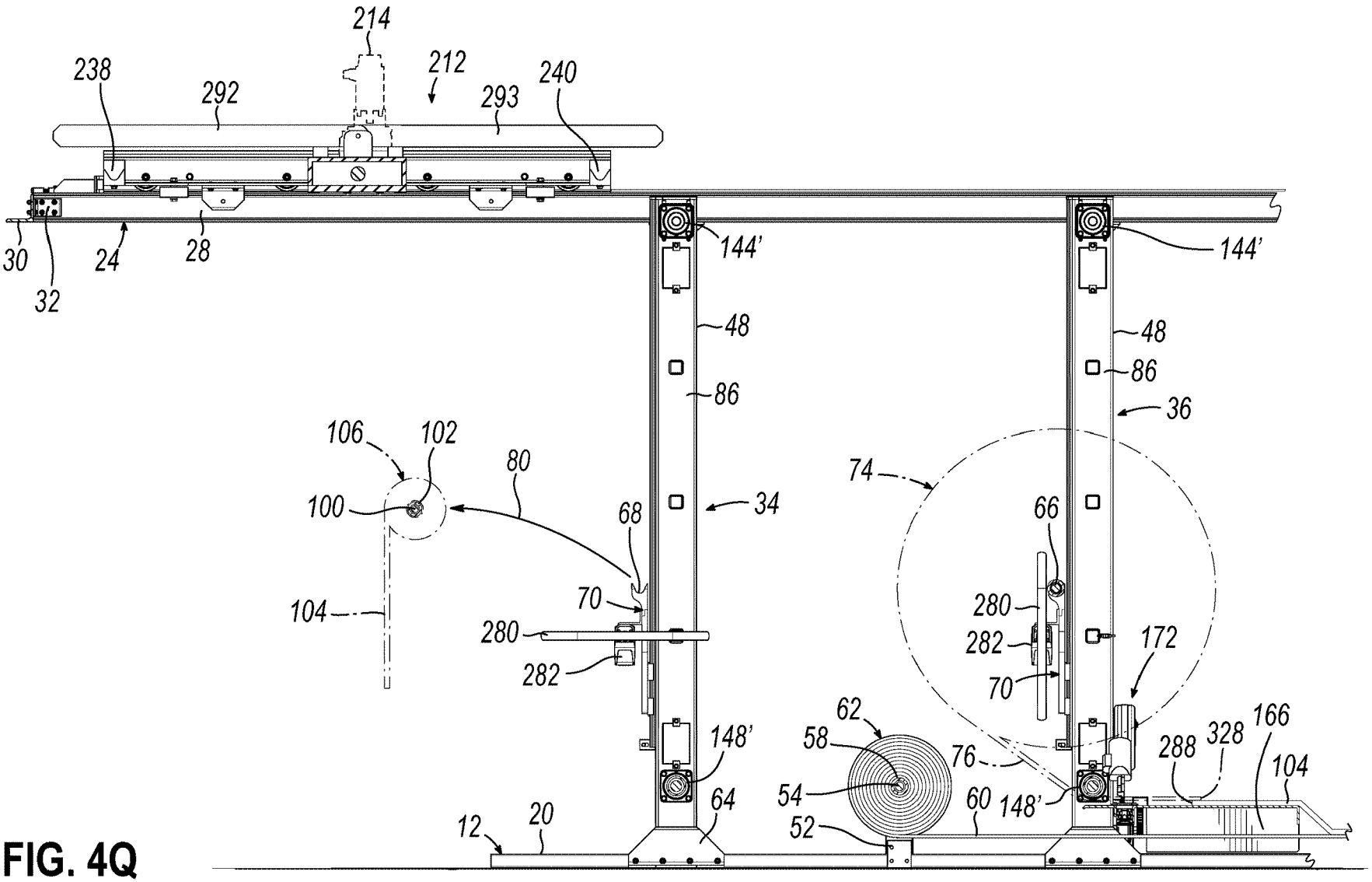
FIG. 4Q is a side view of the portion of the apparatus shown in FIG. 3 showing the first support supporting the used roll being manually removed off the lowered carriages at the loading station.

FIG. 4P illustrates the carriages 70 at the loading station 34 being lowered by the lifting assembly 132 at the loading station 34 as shown by the arrow 326 to a lowered position while the empty trolley 212 remains in its third cleared position shown in FIG. 4O.

FIG. 4Q illustrates the carriages 70 at the loading station 34 in their lowered position to remove a roll of first material 106 from the nests 68 in carriages 70. In order to remove the roll of first material 106, operators must manually remove the first support 100 from the nests 68 in carriages 70 in the direction of arrow 80. The empty trolley 212 remains in its home position.

By virtue of the foregoing, there is thus provided a finished layered soft good 25 shown in FIG. 6 for introduction into a quilter 14. FIG. 6 shows from top to bottom, a first outer layer or ticking layer 128, a web of third material 120, a web of second material 112, a web of first material 104 and a bottom or backing layer 60. The bottom or backing layer 60 is typically a non-woven material.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, more than five layers may be laminated together. The invention in its broader aspects is, therefore, not limited to the specific details, representative apparatus and method, and illustrative examples shown and described. Accordingly, departures may be made from such details without departing from the spirit or scope of the general inventive concept.

Having described the invention, what is claimed is:

1. An apparatus for replacing a roll of soft goods, said apparatus comprising:

a base;

a rail system spaced above the base with legs, the legs extending between the base and rail system;

a trolley movable along the rail system, the trolley having a trolley motor, front support holders and rear support holders;

a loading station at an upstream end of the apparatus;

a plurality of feed stations downstream of the loading station, a lifting assembly at each of the stations for raising and lowering two carriages simultaneously, the lifting assembly comprising a lift motor, a drive leg having a hollow interior and a driven leg having a hollow interior, each of the drive and driven legs having a lower sprocket, an upper sprocket and an endless chain wrapped around the sprockets inside the hollow interior thereof, at each of the stations, a drive assembly extending between the lower sprockets;

at each of the stations, an upper shaft extending between the upper sprockets;

wherein the lift motor rotates the lower sprocket inside the hollow interior of the drive leg, which rotates the drive assembly which rotates the lower sprocket inside the hollow interior of the driven leg, wherein rotation of the lower sprockets rotates the endless chains which rotates the upper sprockets, one of the two carriages at each station being secured to one of the endless chains at each station, each of the carriages having a generally U-shaped nest adapted to support one end of a support extending between two carriages at one of the stations, the support being adapted to fit inside a cardboard tube.

2. The apparatus of claim 1, further comprising a catwalk and a cutting assembly at each of the feed stations.

3. The apparatus of claim 2, wherein each of the side rails has an "I" shaped cross section.

4. The apparatus of claim 1, wherein the apparatus has at least three feed stations.

5. The apparatus of claim 1, further comprising a non-motorized backing station located between the loading station and one of the feed stations.

6. The apparatus of claim 1, wherein the drive assembly comprises multiple shafts joined together.

7. An apparatus for replacing a roll of soft goods, said apparatus comprising:

a base;

a rail system spaced above the base with legs, the legs extending between the base and rail system, the rail system having two ribbed straps, one on each side of the rail system;

a trolley movable along the rail system, the trolley having front and rear support holders and a trolley motor for rotating trolley wheels, the trolley wheels engaging the ribbed straps to move the trolley;

a loading station at an upstream end of the apparatus;

a plurality of feed stations downstream of the loading station;

a lifting assembly at each of the stations for raising and lowering two carriages simultaneously, each of the carriages having a generally U-shaped nest adapted to support a support adapted to fit inside a cardboard tube, the lifting assembly comprising a lift motor, a drive leg having a hollow interior and a driven leg having a hollow interior, each of the drive and driven legs having a lower sprocket, an upper sprocket and an endless chain wrapped around the sprockets inside the hollow interior thereof; and at each of the stations, a drive assembly extending between the lower sprockets and an upper shaft extending between the upper sprockets, wherein the lift motor rotates the lower sprocket inside the hollow interior of the drive leg, which rotates the drive assembly which rotates the lower sprocket inside the hollow interior of the driven leg, wherein rotation of the lower sprockets rotates the endless chains which rotates the upper sprockets, wherein the carriages at each station are secured to the endless chains at each station and move with rotation of the endless chains.

8. The apparatus of claim 7, wherein the trolley is generally rectangular having two side rails and two end rails joined together.

9. The apparatus of claim 7, further comprising a catwalk at each of the feed stations downstream of the legs of the feed station.

10. The apparatus of claim 7, wherein the apparatus has at least three feed stations.

11. The apparatus of claim 7, further comprising a non-motorized backing station located between the loading station and one of the feed stations.

12. The apparatus of claim 7, wherein the drive assembly comprises multiple shafts joined together.

13. An apparatus for replacing a roll of soft goods, said apparatus comprising:

a base;

a rail system spaced above the base with drive legs secured to one side of the base and driven legs secured to the other side of the base, the rail system comprising two side rails and two end rails joined together and two ribbed straps, one of the ribbed straps being secured to each of the side rails of the rail system;

a trolley movable along the rail system, the trolley having a trolley motor for rotating trolley wheels which interact with the ribbed straps to move the trolley, front support holders and rear support holders;

a loading station at an upstream end of the apparatus;

a plurality of feed stations downstream of the loading station, a lifting assembly at each of the stations for raising and lowering two carriages simultaneously, the lifting assembly comprising a lift motor, one of the drive leg having a hollow interior and one of the driven legs having a hollow interior, each of the drive and driven legs having a lower sprocket, an upper sprocket and an endless chain wrapped around the sprockets inside the hollow interior thereof, at each of the stations, a drive assembly extending between the lower sprockets;

at each of the stations, an upper shaft extending between the upper sprockets;

wherein the lift motor rotates the lower sprocket inside the hollow interior of one of the drive legs, which rotates the drive assembly which rotates the lower sprocket inside the hollow interior of the driven leg, wherein rotation of the lower sprockets rotates the endless chains which rotates the upper sprockets, one of the two carriages at each station being secured to one of the endless chains at each station, each of the carriages having a generally U-shaped nest adapted to support one end of a support extending between two carriages at one of the stations.

14. The apparatus of claim 13, further comprising a backing station located between the loading station and the feed stations.

15. The apparatus of claim 14, further comprising a catwalk at each of the feed stations, only one web of material exiting a roll at the feed station passing over the catwalk to allow an operator to cut one of the webs of material prior to removing a roll without cutting other webs of material from rolls upstream of the feed station passing under the catwalk at the feed station.

16. The apparatus of claim 13, wherein the carriages at each station are raised by rotating the chains a first direction and lowered by rotating the chains a second direction.

17. The apparatus of claim 13, further comprising two adjustable paddle brakes per station.

18. The apparatus of claim 13, wherein the carriages at each station raise one of the supports to a raised position and lower the support to a lower position.

19. The apparatus of claim 13, wherein each of the feed stations has a cutting assembly comprising a cutter motor and a linear actuator.

* * * * *